US011083277B2

(12) United States Patent
Sniffen

(10) Patent No.: US 11,083,277 B2
(45) Date of Patent: Aug. 10, 2021

(54) BACKPACK AND LUGGAGE SYSTEMS

(71) Applicant: John Matthew Sniffen, Boulder Creek, CA (US)

(72) Inventor: John Matthew Sniffen, Boulder Creek, CA (US)

( * ) Notice: Subject to any disclaimer, the term of this patent is extended or adjusted under 35 U.S.C. 154(b) by 0 days.

(21) Appl. No.: 16/711,900

(22) Filed: Dec. 12, 2019

(65) Prior Publication Data

US 2020/0187629 A1 Jun. 18, 2020

Related U.S. Application Data

(60) Provisional application No. 62/780,217, filed on Dec. 15, 2018.

(51) Int. Cl.

| | |
|---|---|
| ***A45F 3/00*** | (2006.01) |
| ***A45F 3/04*** | (2006.01) |
| ***A45F 5/00*** | (2006.01) |
| ***A45C 13/02*** | (2006.01) |
| ***A45C 13/10*** | (2006.01) |
| ***A45C 13/26*** | (2006.01) |

(52) U.S. Cl.

CPC ..... *A45F 3/04* (2013.01); *A45C 13/02* (2013.01); *A45C 13/103* (2013.01); *A45C 13/1069* (2013.01); *A45C 13/26* (2013.01); *A45F 5/00* (2013.01); *A45F 2003/045* (2013.01); *A45F 2005/002* (2013.01)

(58) Field of Classification Search

CPC ... A45C 13/02; A45C 13/103; A45C 13/1069; A45C 13/26; A45F 3/04; A45F 5/00; A45F 2003/045; A45F 2005/002

See application file for complete search history.

(56) References Cited

U.S. PATENT DOCUMENTS

| | | | |
|---|---|---|---|
| 4,081,061 | A | 3/1978 | Tucker |
| 4,122,925 | A | 10/1978 | Schultheiss |
| 4,609,084 | A | 9/1986 | Thomas |
| 5,377,887 | A | 1/1995 | Garcia |
| 5,799,851 | A | 9/1998 | Wulf |
| 5,887,770 | A | 3/1999 | Covell |
| 5,934,527 | A | 8/1999 | Neumann |
| 5,944,155 | A | 8/1999 | Geary |
| 6,012,557 | A | 1/2000 | Derelanko |
| 6,230,771 | B1 | 5/2001 | Hellenbrand |
| 6,467,594 | B1 | 10/2002 | Wu |
| 6,601,743 | B2 | 8/2003 | Godshaw |

(Continued)

OTHER PUBLICATIONS

Onli Travel; Onli Venture Backpack; Downloaded on Mar. 4, 2019 from <URL: https://onlitravel.com/collections/home/products/onli-venture-backpack>.

(Continued)

*Primary Examiner* — Peter N Helvey

(74) *Attorney, Agent, or Firm* — Wesley E. Schwie, Esq.; Gallium Law

(57) ABSTRACT

The disclosure includes a modular carrying system comprising a day bag, a luggage bag, and a main coupling system. In some embodiments, the main coupling system includes a first portion coupled to the day bag and a second portion coupled to the luggage bag. The main coupling system may be arranged and configured to detachably couple the day bag and the luggage bag together such that the front side of the day bag faces the back side of the luggage bag.

20 Claims, 23 Drawing Sheets

(56) References Cited

U.S. PATENT DOCUMENTS

| | | | | |
|---|---|---|---|---|
| 7,124,921 | B1 | 10/2006 | Hubbell | |
| 8,919,628 | B2 | 12/2014 | Jamlang | |
| 9,420,871 | B2 | 8/2016 | Roberts | |
| 9,492,003 | B2 | 11/2016 | Patel | |
| 10,694,834 | B2 * | 6/2020 | Logan | A45C 5/141 |
| 2002/0145018 | A1 * | 10/2002 | Godshaw | A45F 4/02 224/153 |
| 2004/0060954 | A1 * | 4/2004 | Hale | A45F 3/08 224/581 |
| 2005/0194413 | A1 * | 9/2005 | Baker | A45F 4/02 224/153 |
| 2007/0175941 | A1 * | 8/2007 | Berry | A45F 3/04 224/583 |
| 2007/0228091 | A1 * | 10/2007 | Shawen | A45F 4/02 224/153 |
| 2009/0127299 | A1 * | 5/2009 | Jamlang | A45F 3/14 224/153 |
| 2010/0237110 | A1 * | 9/2010 | Hunter | A45C 7/0086 224/155 |
| 2010/0282809 | A1 * | 11/2010 | Scicluna | A45C 13/02 224/653 |
| 2011/0284598 | A1 | 11/2011 | Lawson | |
| 2012/0043358 | A1 | 2/2012 | Kelly | |
| 2013/0320053 | A1 | 12/2013 | Kim | |
| 2014/0116829 | A1 * | 5/2014 | Davis | A45C 7/0022 190/103 |
| 2015/0129627 | A1 * | 5/2015 | Roberts | A45F 3/04 224/581 |
| 2015/0320165 | A1 * | 11/2015 | Chi Yueh Chen | A45C 7/0054 190/18 A |
| 2016/0213132 | A1 | 7/2016 | Ford | |
| 2016/0302542 | A1 * | 10/2016 | Yun | A45C 7/0045 |
| 2017/0258207 | A1 | 9/2017 | Blanton | |

OTHER PUBLICATIONS

Salkan; Two Backpacks That Travel as One; Downloaded on Oct. 18, 2019 from <URL: https://www.discoversalkan.com/>.

Hylete; Icon 6-In-1 Backpack 60L; Downloaded on Sep. 28, 2018 from <URL: https://www.hylete.com/icon-6-in-1-backpack-stealth-black-60-liter>.

Wool and Oak; Voyager Set; Downloaded on Sep. 28, 2018 from <URL: https://www.woolandoak.com/products/voyager-set#0>.

* cited by examiner

BACKPACK AND LUGGAGE SYSTEMS

CROSS-REFERENCE TO RELATED APPLICATIONS

This application claims the benefit and priority of U.S. Provisional Patent Application No. 62/780,217; filed Dec. 15, 2018; and entitled BACKPACK AND LUGGAGE SYSTEMS; the entire contents of which are incorporated herein by reference.

BACKGROUND

Field

Various embodiments disclosed herein relate to backpack and luggage systems. Certain embodiments relate to modular carrying systems.

Description of Related Art

As traveling becomes commonplace, whether for work, pleasure, or other motives, the art of traveling has become a refined skill that continues to be honed. Many travelers wish to minimize baggage to speed up the process of getting from "point A" to "point B". Such travelers skip checking luggage at airports and on trains, and opt to carry everything. Further, in our busy lives, we already carry a certain amount of essential items in our everyday life. When packing, it's often difficult to figure out what to take, where to pack it, and where it is once it's packed. Our habits of daily life get disrupted during travel, creating a sense of anxiety or 'drag' around feeling that makes any sort of journey feel less pleasant.

Once at a destination, a carry-on suitcase can still prove to be a hassle as the traveler must lug a bag around, and in some circumstances, be on constant guard to ensure that the contents of the bag are safe from thieves. As well, a single bag or suitcase for all of one's items oftentimes makes for disorganization within the bag as the items are jumbled around during travel. Picking out desired items can be a hassle and take up valuable time as a traveler is forced to reorganize the contents in search of a single item.

Modular bags and backpacks have gained popularity in recent years. Due to the modular nature, such bags are easily adaptable to different setups, loads, and environments. Modular bags are, in essence, bags that feature a range of smaller "modules" that can be used in combination with a primary bag. The smaller modules are typically smaller bags and pouches that may attach to either the inside or the outside of the primary bag. While the modular bags currently in the marketplace may increase ease of travel, the way in which the smaller modules attach to the primary bag leaves both the primary bag and the modules susceptible to theft. Pockets are typically outwardly facing and modules are often attached to the primary by a single means, such a buckle or snap.

While outwardly facing modules may allow a user of such a bag ease of rearranging the configuration of the modular bag and easy access to contents of the bag and modules, such a configuration may also allow access to thieves and pickpockets. Similar to a typical bag or backpack, the openings of modular bags are exposed. As modular bags are often worn on the back of a user, the user has no way of ensuring that the modules and contents of the bags are safe from theft. Furthermore, the connection of modular bags between the primary bag and the modules is often visible and may be disconnected by anyone within a reaching distance. And due to the form of these bags, a user may not notice a missing piece until it is too late. Thus, there is a need for a modular bag with pockets that may be securely retained such that users do not have to worry about the modules and the contents of the bags and modules being stolen.

SUMMARY

The disclosure includes a backpack and luggage system. The backpack and luggage system may be defined as a modular carrying system. The system may include a day bag having a front side, a back side located opposite the front side, and a hollow inner portion located between the front side and the back side. The day bag may have a pair of shoulder straps extending away from the back side. As well, the day bag may include a first fastener that may be arranged and configured to open and close the hollow inner portion.

As well, the modular carrying system may include a luggage bag. The luggage bag may have a front side, a back side located opposite the front side, and a hollow inner portion located between the front side and the back side. The luggage bag may also include a second fastener that may be arranged and configured to open and close the hollow inner portion.

Furthermore, the modular carrying system may include a main coupling system. The main coupling system may comprise a first portion that may be coupled to the day bag and a second portion that may be coupled to the luggage bag. The main coupling system may be arranged and configured to detachably couple the day bag and the luggage bag together such that the front side of the day bag may face the back side of the luggage bag.

In some embodiments, the system includes a large pouch located on the back side of the luggage bag. The large pouch may be arranged and configured to receive at least a portion of the day bag. In some embodiments, a lower portion of the large pouch defines a substantially rectangular shape and an upper portion of the large pouch defines a substantially ovoid shape. The lower portion may define a greater depth than the upper portion of the large pouch. In several embodiments, the first portion of the main coupling system is located on at least one of a top side of the day bag and the back side of the day bag. The second portion of the main coupling system may be located on at least one of the upper portion of the large pouch and the lower portion of the large pouch. In some embodiments, the first portion of the main coupling system located on the top side of the day bag is configured to detachably couple with the second portion of the main coupling system located on the upper portion of the large pouch, and the first portion of the main coupling system located on the back side of the day bag is configured to detachably couple with the second portion of the main coupling system located on the lower portion of the large pouch.

As well, the day bag may comprise a small pouch located along at least one of a top side of the day bag and the back side of the day bag. The modular carrying system may also include an essential bag that may be sized and configured to be detachably retained within the small pouch. In some embodiments, the small pouch comprises a zipper closure.

In several embodiments, the modular carrying system includes an essential bag coupling system coupled to the day bag. The essential bag coupling system may include at least one of a G hook and a fastener arranged and configured to securely couple the essential bag to the day bag. In some embodiments, the essential bag coupling system includes at least one of a magnetic fastener and a buckle. The at least one of the magnetic fastener and the buckle may also be arranged and configured to securely couple the essential bag to the day bag. In some embodiments, the essential bag coupling system is located along a top portion of the day bag.

The essential bag coupling system may include a first buckle and a second buckle. A female end of the first buckle may be coupled to the top side of the day bag, and a female end of the second buckle may be coupled to the top side of the day bag and may be spaced from the first buckle. In some embodiments, a male end of the first buckle is coupled to the essential bag and a male end of the second buckle is coupled to the essential bag. The female end of the first buckle coupled to the top side of the day bag may be arranged and configured to receive the male end of the first buckle coupled to the essential bag. The female end of the second buckle coupled to the top side of the day bag may be arranged and configured to receive the male end of the second buckle coupled to the essential bag to thereby detachably couple the essential bag to the day bag.

In some embodiments, the essential bag includes a waist strap and a waist strap management device. The waist strap management device may be arranged and configured to receive at least a portion of the waist strap and thereby keep the at least the portion of the waist strap neatly tucked away.

In several embodiments, the main coupling system includes at least one of at least one magnetic fastener, at least one buckle, and at least one zipper that may be arranged and configured to lockably couple the luggage bag to the day bag. The main coupling system may be located along a top portion of the day bag and a top portion of the luggage bag. The main coupling system may be further located along a back portion of the day bag and a back portion of the luggage bag.

In some embodiments, the main coupling system includes at least two of at least one magnetic fastener, at least one buckle, and at least one zipper that may be arranged and configured to lockably couple the luggage bag to the day bag. The main coupling system may comprise the zipper. In some embodiments, the zipper is located around a perimeter of the day bag.

The luggage bag may include a grab handle. The grab handle may be located along a top portion of the luggage bag. In some embodiments, the grab handle is located along a side portion of the luggage bag.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

DETAILED DESCRIPTION

Figure 1:
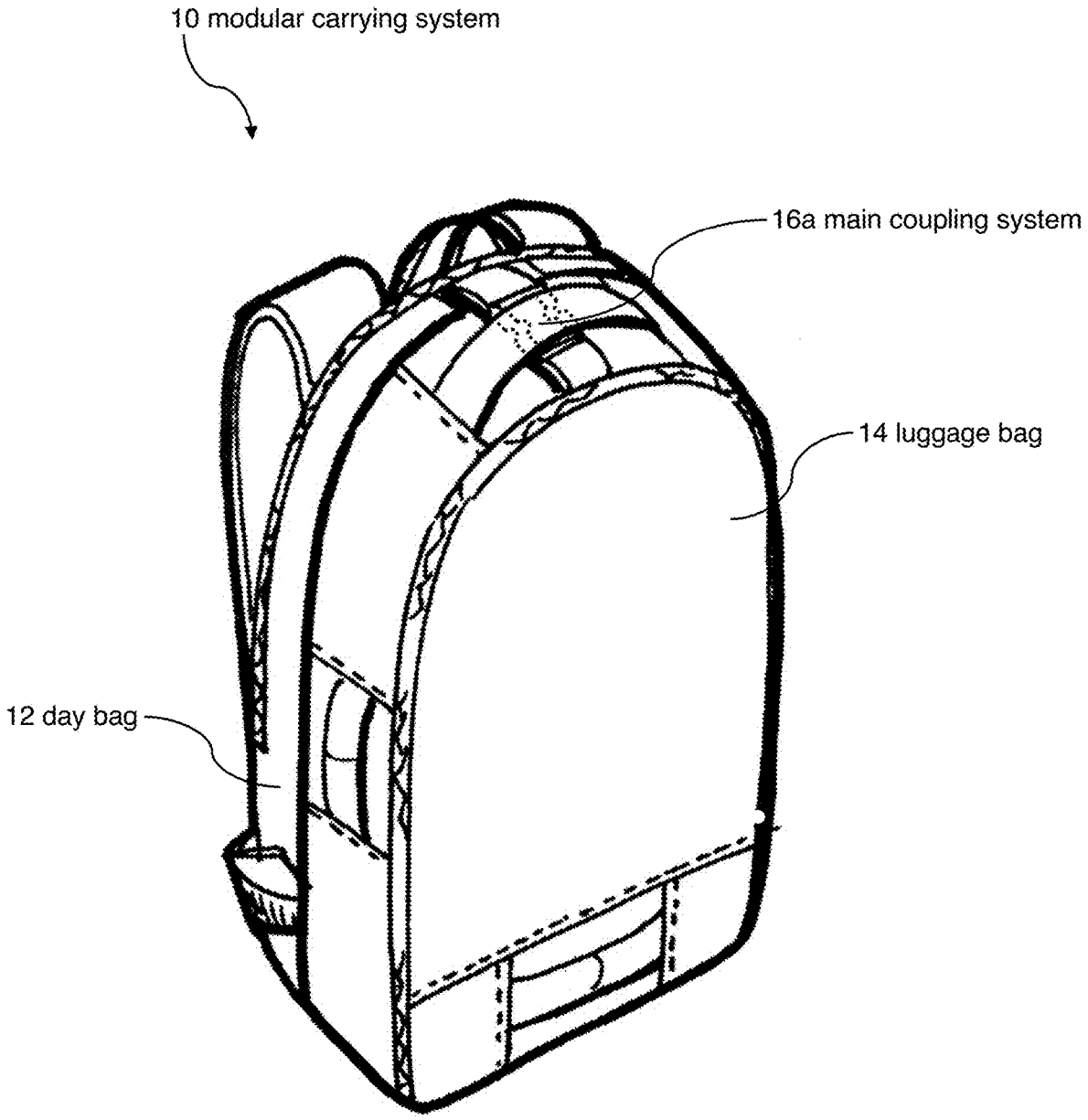
FIG. 1 illustrates a perspective view of a modular carrying system, according to some embodiments.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

REFERENCE NUMERALS

10—Modular carrying system
12—Day bag
14—Luggage bag
16—Main coupling system
18*a*—Front side of day bag
18*b*—Front side of luggage bag
20*a*—Back side of day bag
20*b*—Back side of luggage bag
21*a*—Top side of day bag
22*a*—Hollow inner portion of day bag
22*b*—Hollow inner portion of luggage bag
24—Shoulder straps
26—First fastener
28—Second fastener
30*a*—First end
30*b*—First end
32*a*—Second end
32*b*—Second end

34—Grab handle
40—Large pouch
42—Small pouch
50—Essential bag
52—Essential bag coupling system
54—Waist strap
56—Waist strap management device
60—First strap
62—Second strap
64—Pocket
66*a*—First portion
66*b*—Second portion
68*a*—G hook
68*b*—G hook fastener
70*a*—Female end of first buckle
70*b*—Female end of second buckle
70*c*—Male end of first buckle This disclosure intends to provide systems to aid in ease of travel. Such systems may comprise a modular carrying system that may include a day bag and a luggage bag. The day bag and the luggage bag may be detachably coupled by a main coupling system. The luggage bag may couple to the day bag in such a fashion that the luggage bag may cover a front side of the day bag. As well, the luggage bag may include a grab handle, such that the luggage bag may be carried by a user separately from the day bag. Additionally, the modular carrying system may include an essential bag. The day bag may comprise an essential bag coupling system such that the essential bag may detachably couple to the day bag. As such, the day bag, the luggage bag, and the essential bag may each be removed from the modular carrying system and used separately. The modules of the modular carrying system may allow a user to separately pack items relative to use, such as items for an extended trip (e.g., clothes, toiletries) in the luggage bag, items for a day trip (e.g., sunscreen, cameras, maps) in the day bag, and personal items (e.g., wallet, phone) in the essential bag.

FIG. 1 illustrates a modular carrying system 10. The modular carrying system 10 may include a day bag 12, a luggage bag 14, and a main coupling system 16. The main coupling system 16*a* may be arranged and configured to detachably couple the day bag 12 to the luggage bag 14. The main coupling system 16*a* may comprise at least one coupling means, wherein the day bag 12 and the luggage bag 14 may each include at least one part of the at least one coupling means.

Figure 2:
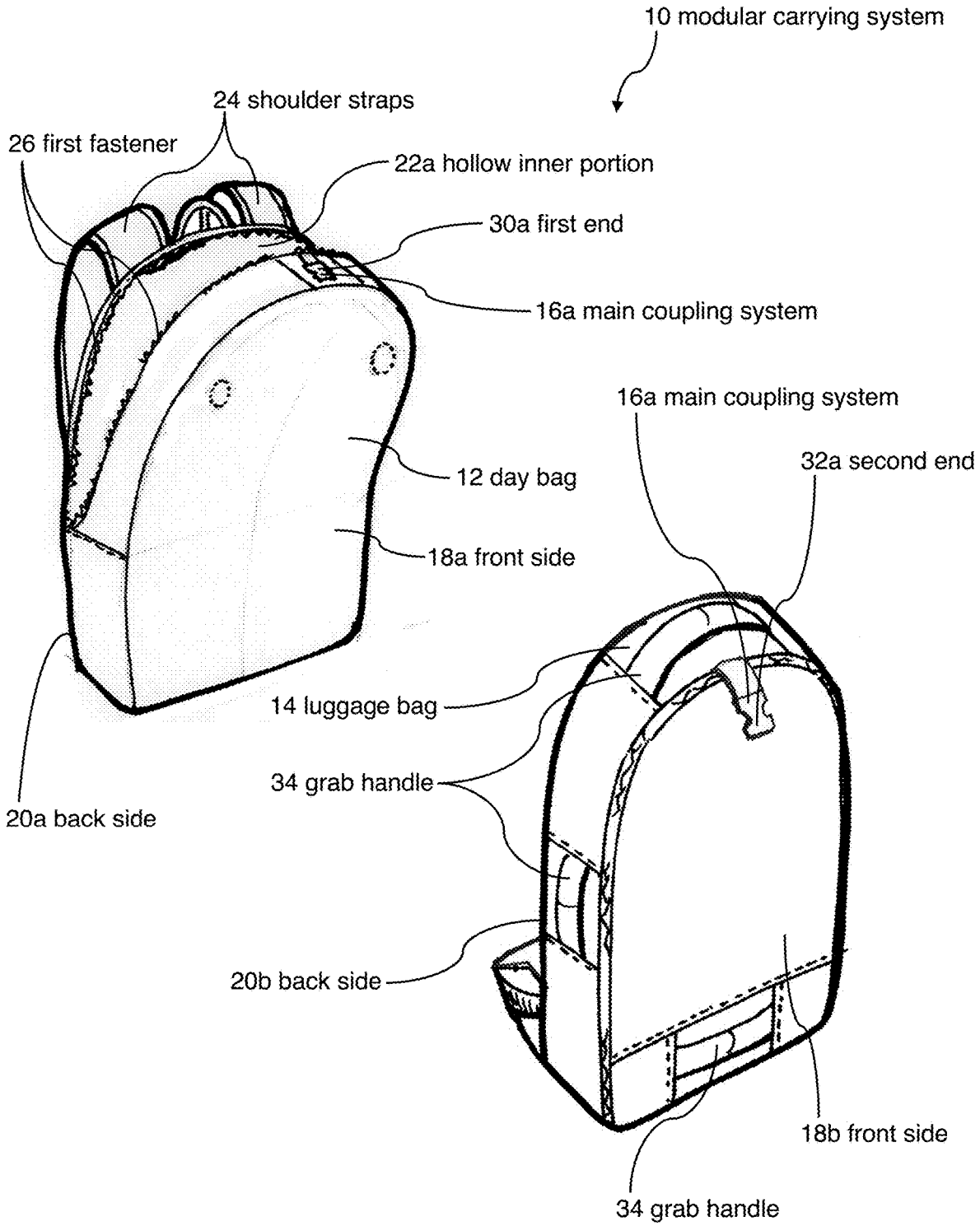
FIG. 2 illustrates an exploded perspective view of a modular carrying system, according to some embodiments.

FIG. 2 further illustrates the modular carrying system 10. The modular carrying system 10 may include the day bag 12. The day bag 12 may have a front side 18*a*, a back side 20*a* located opposite the front side 18*a*, and a hollow inner portion 22*a*. The hollow inner portion 22*a* may be located between the front side 18*a* and the back side 20*a*. As well, the day bag 12 may include a pair of shoulder straps 24 that may extend away from the back side 20*a*. The shoulder straps 24 may connect to a top portion of the back side 20*a* and a bottom portion of the back side 20*a*.

In some embodiments, the day bag includes a first fastener 26. The first fastener 26 may be arranged and configured to open and close the hollow inner portion 22*a* and thus allow and prevent access to the hollow inner portion 22*a*. The first fastener 26 may comprise at least one of a zipper, snap, clip, clasp, buckle, flap, button, draw string, and the like.

In some embodiments, the modular carrying system 10 includes the luggage bag 14. The luggage bag 14 may have a front side 18*b* and a back side 20*b* located opposite the front side 18*b*. As well, the luggage bag 14 may include at least one grab handle 34. The at least one grab handle 34 may be located along at least one of a top portion, a side portion, and the front side 18*b* of the luggage bag 14. In some embodiments, the luggage bag 14 includes a plurality of grab handles 34.

With added reference to FIG. 2, the modular carrying system 10 may include the main coupling system 16*a*. The main coupling system 16*a* may have a first end 30*a* that may be coupled to the day bag 12, and a second end 32*a* that may be coupled to the luggage bag 14. The first end 30*a* and the second end 32*a* may be detachably coupled. The main coupling system 16*a* may be arranged and configured to detachably couple the day bag 12 and the luggage bag 14 such that the front side 18*a* of the day bag 12 may face the back side 20*b* of the luggage bag 14.

In some embodiments, the main coupling system 16*a* comprises a buckle. The buckle may include a female end and a male end. The first end 30*a* may define at least one of the female end and the male end. The second end 32*a* may define at least one of the female and the male end. In some embodiments, the first end 30*a* defines the female end and the second end 32*a* defines the male end. The first end 30*a* may be insertably coupled to the second end 32*a*, such that the luggage bag 14 may be detachably coupled to the day bag 12. It should be appreciated that the main coupling system 16*a* may be located along at least one of a top portion and a side portion of the day bag 12.

Figure 3:
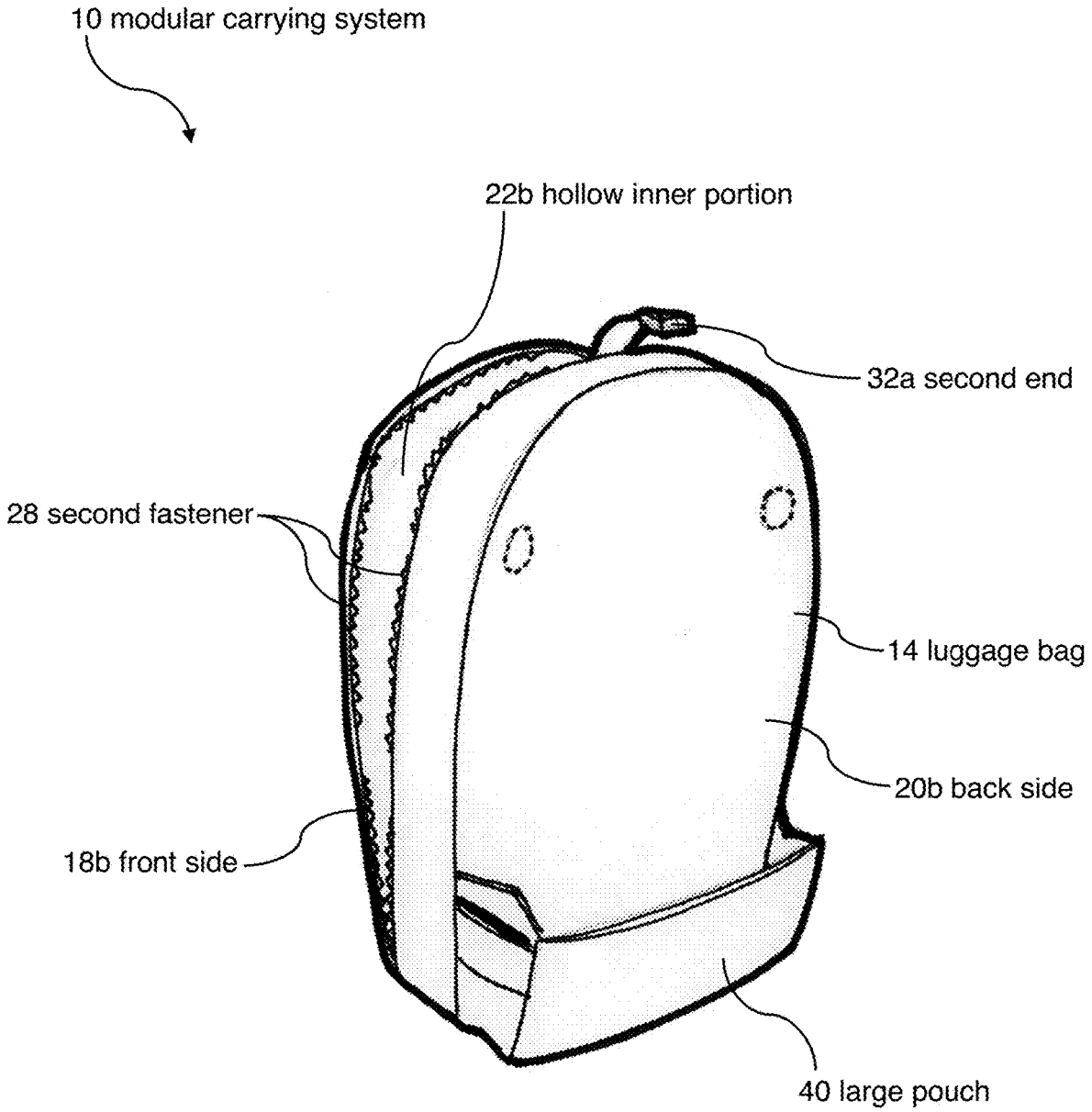
FIG. 3 illustrates a perspective view of a luggage bag, according to some embodiments.

As illustrated in FIG. 3, the luggage bag 14 may include a second fastener 28. The second fastener 28 may be located on the front side 18*b* of the luggage bag 14. The second fastener 28 may be arranged and configured to open and close the hollow inner portion 22*b* of the luggage bag 14 and thus allow and prevent access to the hollow inner portion 22*b*. The second fastener 28 may comprise at least one of a zipper, snap, clip, clasp, buckle, flap, button, draw string, and the like.

In some embodiments, the second fastener 28 is located on the back side 20*b* of the luggage bag 14 such that when the luggage bag 14 is coupled to the day bag 12, the second fastener 28 may not be accessed. The position of the second fastener 28 may allow a user peace of mind when travelling, as no one may access the contents of the luggage bag 14 while the luggage bag 14 is coupled to the day bag 12. Backpacks currently in the market have zipper openings facing away from whomever is wearing the backpack. Travelers are often weary when utilizing backpacks, as outwardly facing zippers may allow access to anyone within reach. The position of the luggage bag 14 may ensure protection of contents in the day bag 12 and the luggage bag 14.

With added reference to FIG. 3, the luggage bag 14 may include a large pouch 40. The large pouch 40 may protrude from the back side 20*b* of the luggage bag 14. The large pouch 40 may be arranged and configured to receive at least a portion of the day bag 12. The day bag 12 may be at least partially confined within the large pouch 40 of the luggage bag 14 and thus securely coupled to the luggage bag 14.

In some embodiments, a bottom end of the shoulder straps 24 is detachably coupled to a bottom portion of the back side 20*a* of the day bag 12. The bottom end of the shoulder straps 24 may include at least two fasteners that may be detachably coupled to the day bag 12. The at least two fasteners may include at least two of a magnet, a buckle, a carabineer, a clasp, a button, a zipper, and the like. As such, a bottom portion of the day bag may include at least two fasteners. The at least two fasteners may comprise at least two of a magnet, a buckle, a carabineer, a clasp, a button, a zipper, and the like. The at least two fasteners of the shoulder straps 24 may be detachably coupled to the at least two fasteners on the back side 20*a* of the day bag.

Furthermore, an outer portion of the large pouch 40 of the luggage bag 14 may include at least two fasteners. The at least two fasteners may include at least two of a magnet, a buckle, a carabineer, a clasp, a button, a zipper, and the like. The at least two fasteners on the shoulder straps 24 of the day bag 12 may be detachably coupled to the at least two fasteners on the large pouch 40 of the luggage bag 14.

In some embodiments, the bottom end of the shoulder straps 24 are detachably coupled to the bottom portion of the day bag 12. The bottom end of the shoulder straps 24 may include at least two fasteners that may be detachably coupled to the day bag 12. As such, a bottom portion of the day bag may include at least two fasteners. The large pouch 40 of the luggage bag 14 may include at least two holes that may be arranged and configured to allow the at least two fasteners on the back side 20*a* of the day bag 12 to pass through the large pouch 40. The at least two fasteners of the bottom portion of the shoulder straps 24 may detachably couple to the at least two fasteners of the bottom portion of the day bag 12 that have passed through the at least two holes on the back side 20*b* luggage bag 14.

Figure 4:
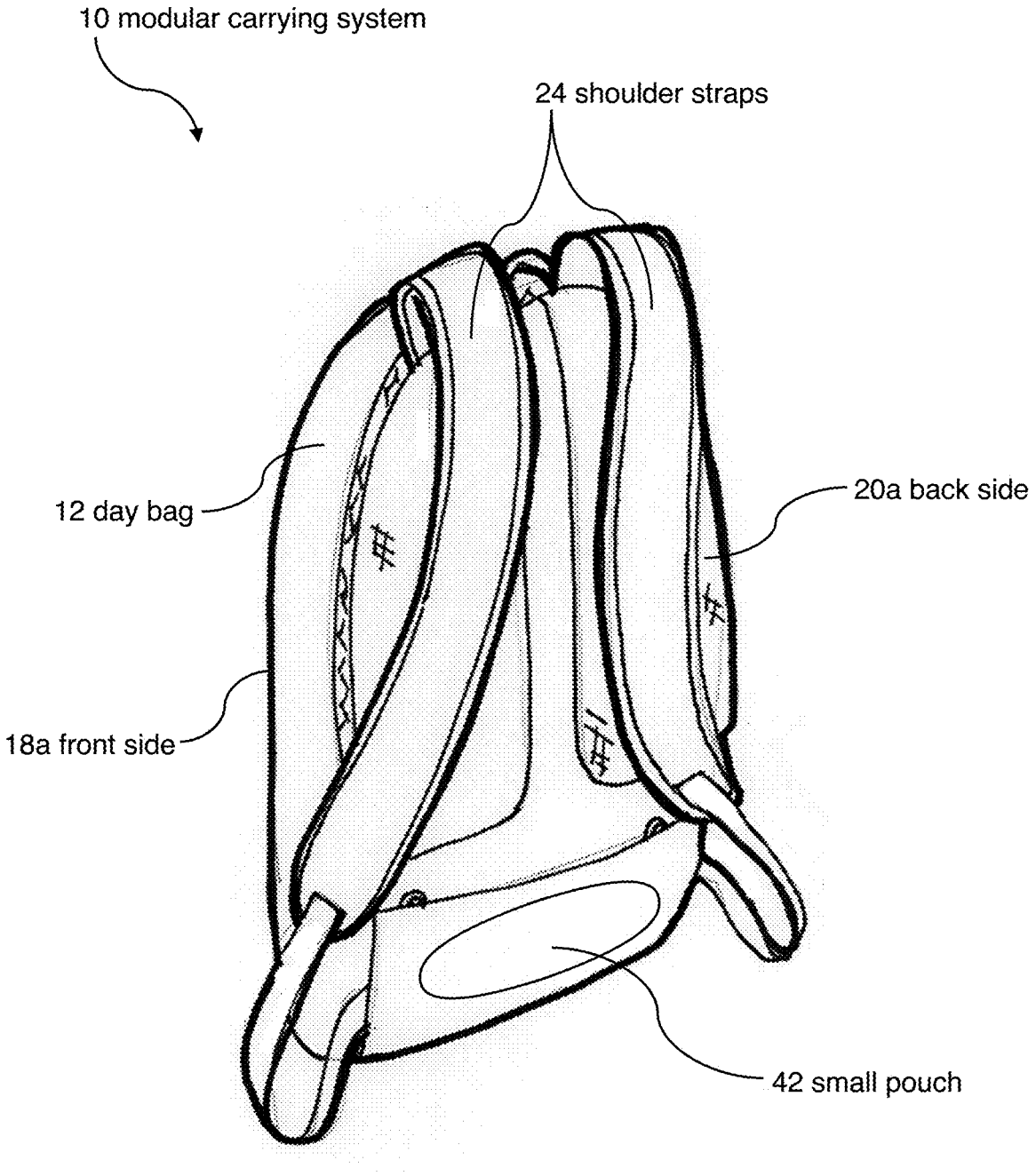
FIG. 4 illustrates a perspective view of a day bag, according to some embodiments.

Referring now to FIG. 4, the day bag 12 may include a small pouch 42. The small pouch 42 may be located along the back side 20*a* of the day bag 12. In some embodiments, the small pouch 42 is located along a bottom portion of the back side 20*a* of the day bag 12. The small pouch 42 may be sized and configured to receive an essential bag 50, which will be discussed in further detail below.

In some embodiments, the small pouch 42 is covered by the large pouch 40 of the luggage bag 14 when the at least the portion of the day bag 12 is received within the large pouch 40 of the luggage bag 14. As such, the large pouch 40 may retain the essential bag 50 within the small pouch 42. In some embodiments, the small pouch 42 is located along a top portion of the back side 20*a* of the day bag 12. Such location may allow a user of the modular carrying system 10 fast and easy access to the essential bag 50 without having to remove the day bag 12 from the large pouch 40 of the luggage bag 14.

Figure 5A:
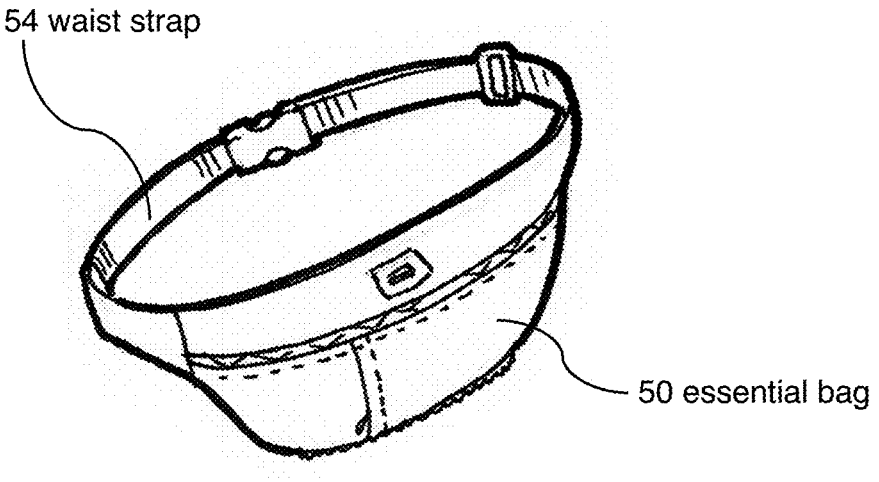
FIGS. 5A and 5B illustrate perspective views of an essential bag, according to some embodiments.

With reference to FIG. 5A, the modular carrying system 10 may include the essential bag 50. The essential bag 50 may comprise a waist bag (commonly referred to as a "fanny pack"). The essential bag 50 may include a waist strap 54. In some embodiments, the waist strap 54 comprises two parts that are coupled by a fastener. The fastener may include at least one of a buckle, snap, clip, clasp, button, hook and loop fastener, and the like.

In some embodiments, the essential bag 50 is used independently from the day bag 12. The essential bag 50 may carry personal items, such as a passport, a phone, a wallet, keys, lip balm, headphones, a phone charger, and the like. The waist strap 54 may wrap around a user's waist for easy, hands-free carrying of the essential bag 50. The essential bag 50 may be purposed to store a user's essential items separately from the modular carrying system 10, such that the user may have direct access to such items.

Figure 5B:
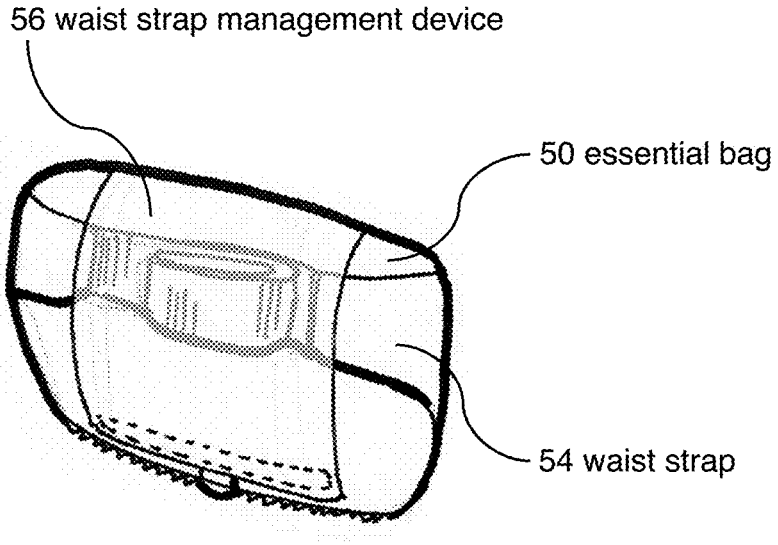

As illustrated in FIG. 5B, the essential bag 50 may include a waist strap management device 56. The waist strap management device 56 may be arranged and configured to receive at least a portion of the waist strap 54 and thereby keep the at least the portion of the waist strap 54 neatly tucked away. The waist strap management device 56 may be coupled to a top portion of the essential bag 50

In some embodiments, the waist strap management device 56 comprises a fabric flap that may fold over a back side of the essential bag. The waist strap 54 may be wound up on the back side of the essential bag 50 and secured beneath the fabric flap of the waist strap management device 56. The waist strap management device 56 may be coupled to a top portion of the essential bag 50 and detachably coupled to a bottom portion of the essential bag 50. The waist strap management device 56 may detachably couple to the bottom portion of the essential bag 50 by means of at least one of a hook and loop fastener, button, zipper, snap, clip, clasp, and the like. The user of the modular carrying system 10 may couple the waist strap management device 56 to the bottom portion of the essential bag 50 while the user is utilizing the essential bag 50 to keep the fabric flap out of the way. As well, the user may tuck the fabric flap into an inner portion of the essential bag 50.

Figure 6:
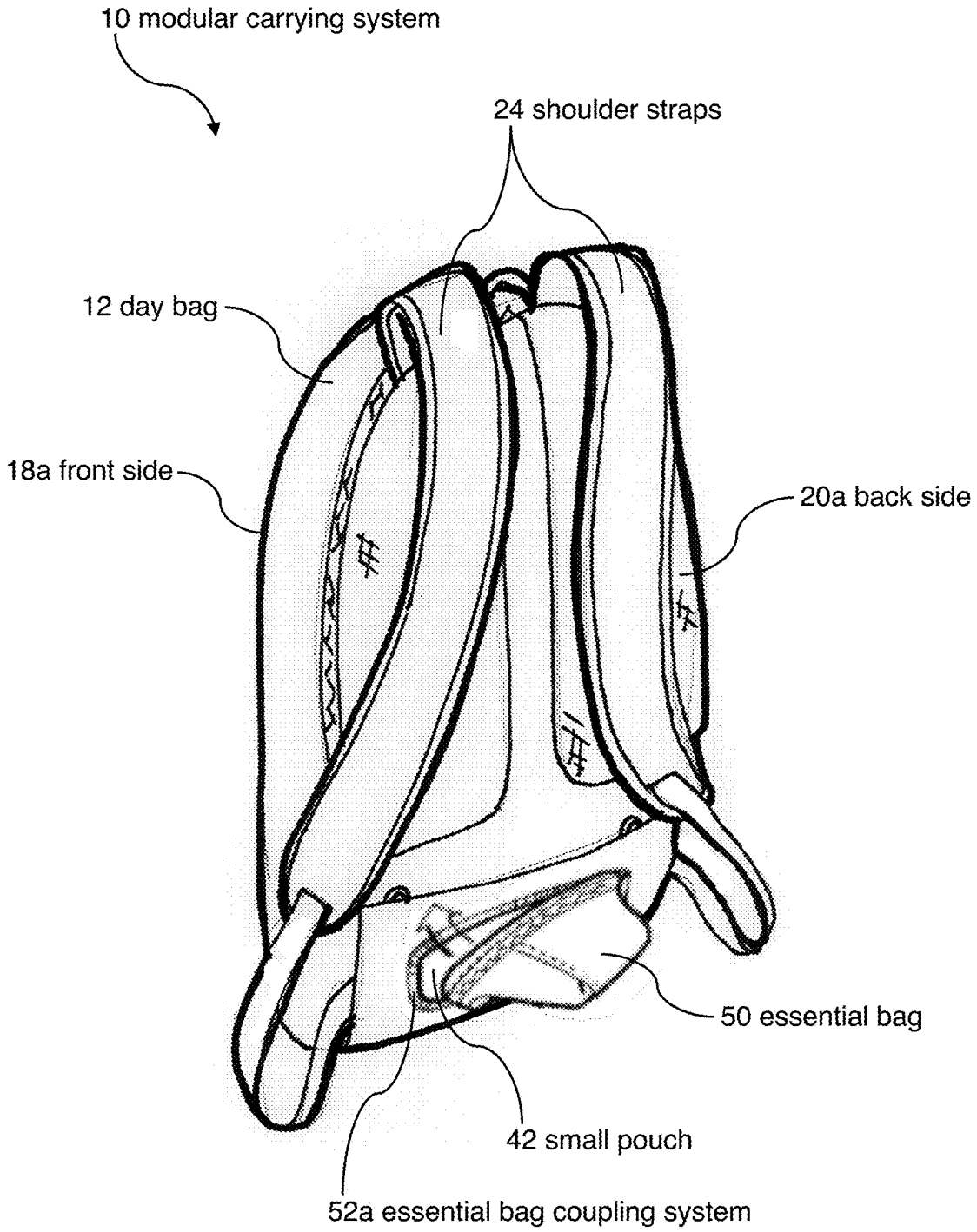
FIG. 6 illustrates a perspective view of a modular carrying system, according to some embodiments.

Referring now to FIG. 6, the modular carrying system 10 may include an essential bag coupling system 52*a*. The essential bag coupling system 52*a* may be located on the back side 20*a* of the day bag 12. At least a portion of the essential bag coupling system 52*a* may comprise elastic material. The elastic material may be arranged and configured to securely couple the essential bag 50 to the day bag 12.

In some embodiments, the essential bag coupling system 52*a* comprises at least a portion of the small pouch 42 located on the back side 20*a* of the day bag 12. The essential bag 50 may be inserted into the small pouch 42 and retained within the small pouch 42 by the elastic material of the essential bag coupling system 52*a*. The essential bag 50 may thus be carried between the day bag 12 and a body of the user of the modular carrying system 10 such that the essential bag 50, and thus contents thereof (e.g., a wallet), may be safely stowed away. The essential bag coupling system 52*a* may be arranged and configured such that the user of the modular carrying system 10 may easily remove the essential bag 50 from the small pouch 42 by stretching the elastic material and withdrawing the essential bag 50.

Figure 7A:
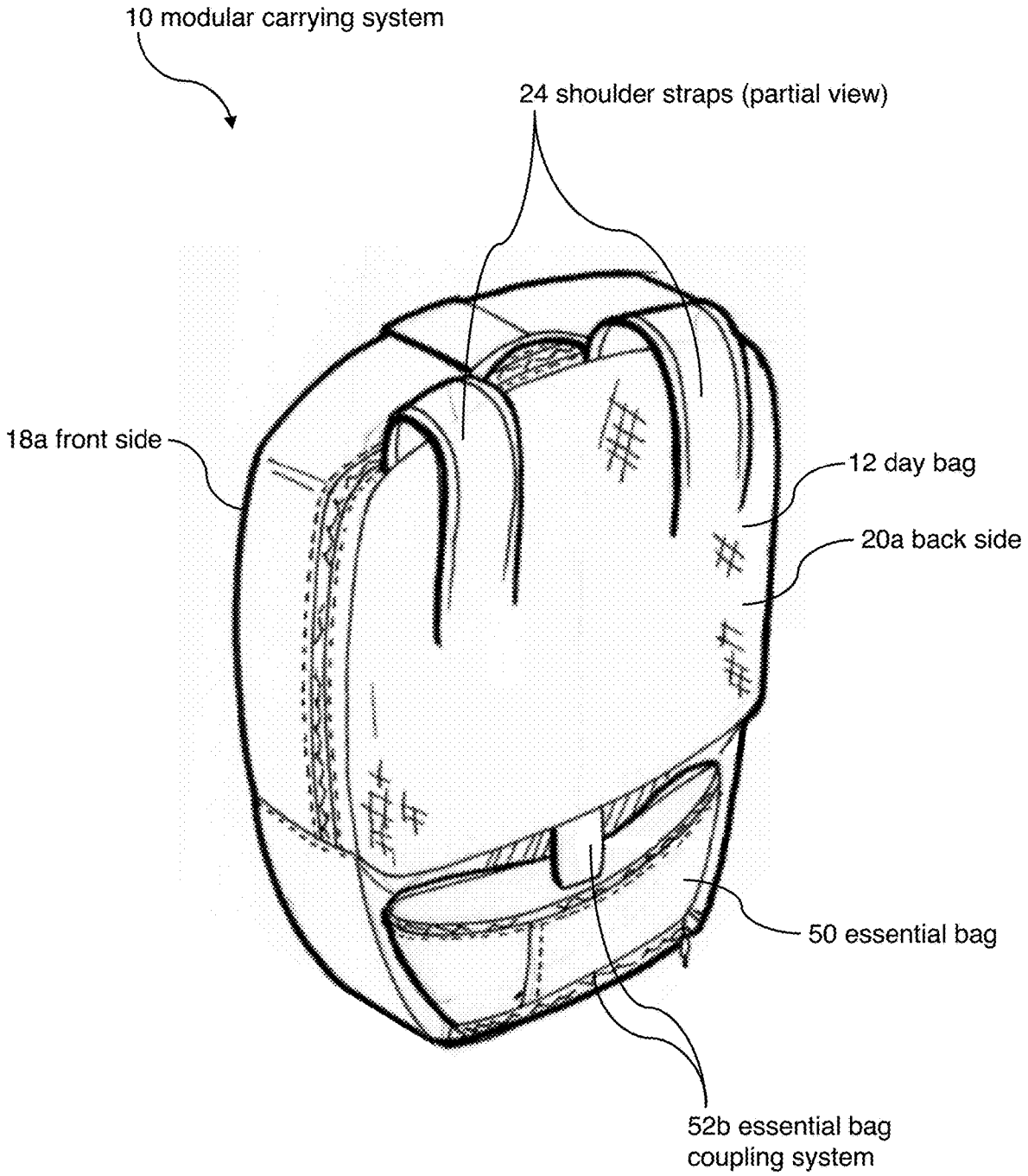
FIGS. 7A, 7B, 7C, 8, and 9 illustrate perspective views of a modular carrying system, according to some embodiments.

As illustrated in FIG. 7A, the day bag 12 may further include an essential bag coupling system 52*b* that may be located on the back side 20*a* of the day bag 12. The essential bag coupling system 52*b* may include at least one of a magnet and a fastener that may be arranged and configured to couple the essential bag 50 to the day bag 12. The essential day bag 50 may include a magnet located along a top portion of the essential bag 50 to thereby couple the essential bag 50 to the day bag 12. The at least one of the magnet and the fastener may be located on the back side 20*a* of the day bag 12 such that the at least one of the magnet and the fastener may couple to the top portion of the essential bag 50. In some embodiments, the fastener comprises at least one of a buckle, hook and loop fastener, button, snap, clip, clasp, and the like.

In some embodiments, the essential bag coupling system 52*b* further includes a zipper. The zipper may be located along a bottom portion of the back side 20*a* of the day bag 12. The zipper may couple to a bottom portion of the essential bag 50, wherein the essential bag 50 may comprise a zipper to thereby couple to the essential bag coupling system 52*b*. In some embodiments, the essential bag coupling system 52*b* comprises a fastener located along the bottom portion of the back side 20*a* of the day bag 12. The fastener may include at least one of a hook and loop fastener, at least one button, at least one snap, at least one clip, at least one clasp, and the like, located along a bottom portion of the back side 20*a* of the day bag 12. The essential bag 50 may comprise a fastener that may couple to the essential bag coupling system 52*b* along the bottom portion of the day bag 12.

Figure 7B:
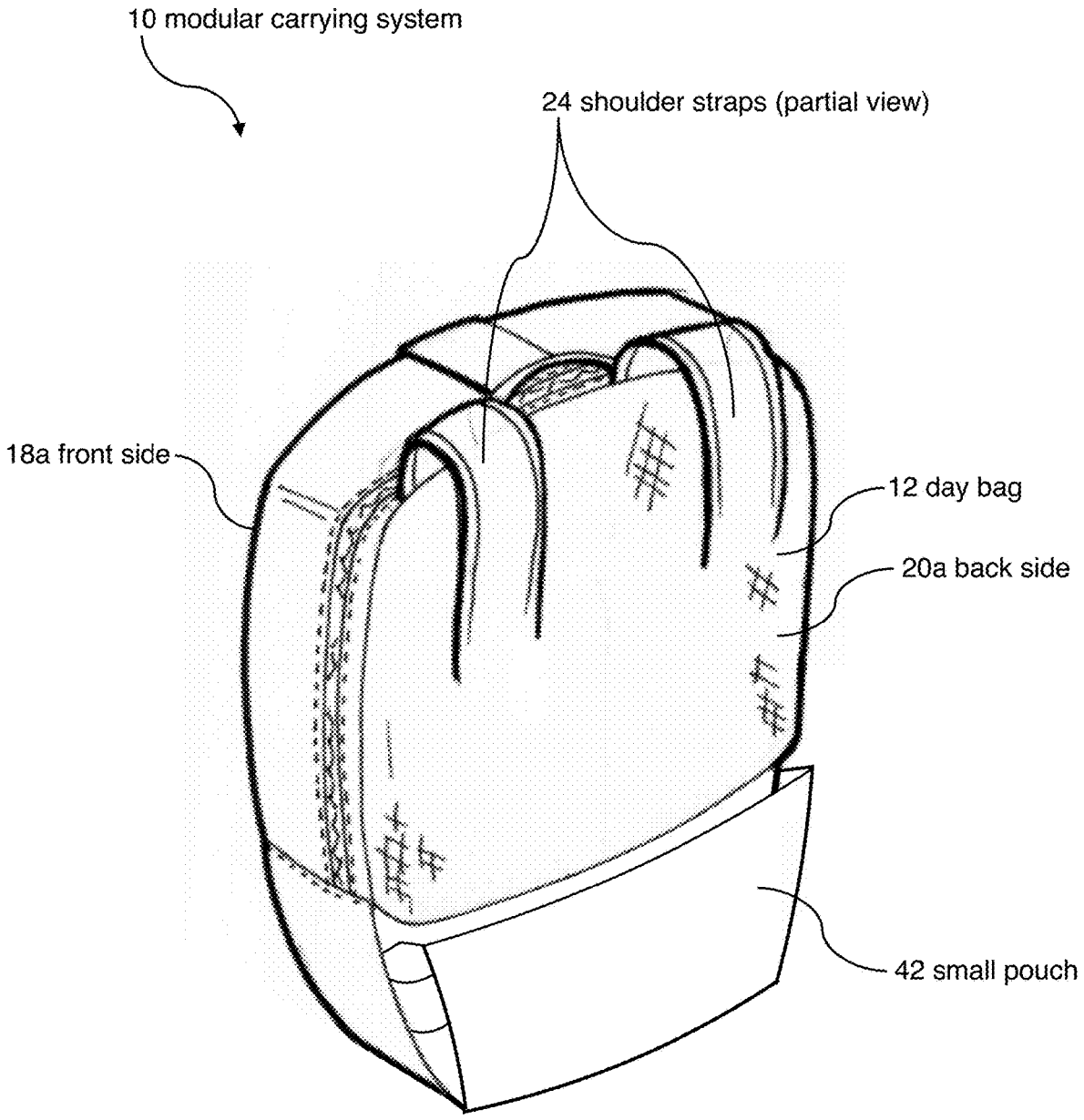
Figure 7C:
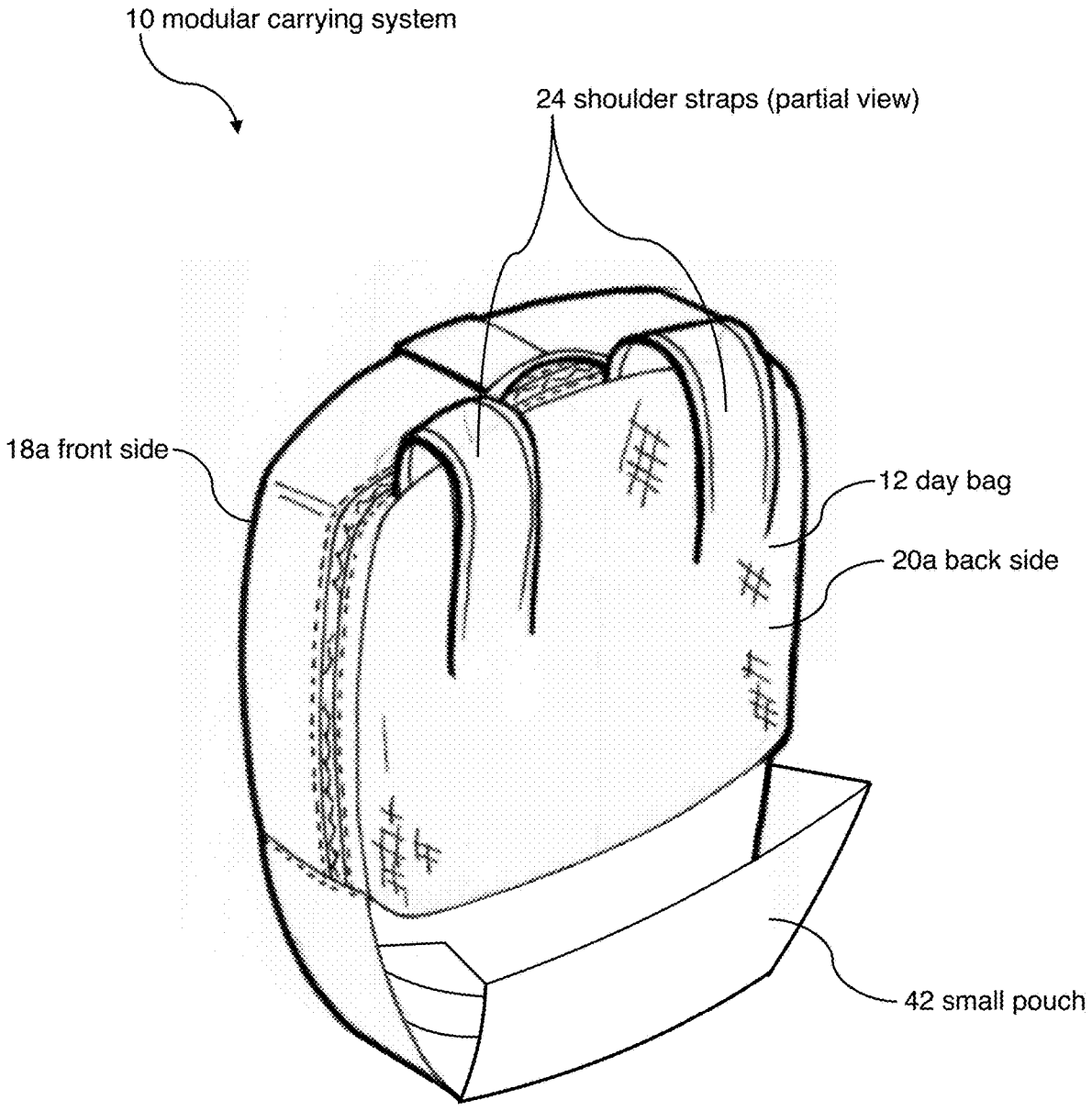

With reference to FIGS. 7B and 7C, the day bag 12 may include the small pouch 42. The small pouch 42 may be located along the back side 20*a* of the day bag 12, and may protrude from the back side 20*a*. The small pouch 42 may be arranged and configured to receive the essential bag 50. A top portion of the small pouch 42 may not be coupled to the back side 20*a* such that the essential bag 50 may be received within the small pouch 42.

As shown in FIG. 7B, the back side 20*a* of the day bag 12 located above the small pouch 42 may comprise a padded material, such that substantially an entire surface of the back side 20*a* may extend along a same plane. The padding may comprise at least one of cotton, felt, gel, foam, wool, rubber, and the like. The padding may disperse the weight of the day bag 12 along substantially an entire surface of the user's back and may thus prevent weight of the day bag 12 from being focused on a single area where the day bag 12 may meet the back of the user.

As illustrated in FIG. 7C, the small pouch 42 may extend away from the back side 20*a* of the day bag. Side portions of the small pouch 42 may be extendable such that the small pouch 42 may be opened and closed to allow items to be received within the small pouch 42. The user of the modular carrying system 10 may thereby pull the small pouch 42 open and place the essential bag 50 within the small pouch 42. When the user releases the small pouch 42, the small pouch 42 may fold back around the essential bag 50 to thereby secure the essential bag 50 within the small pouch. The small pouch 42 may comprise at least one of Lycra, elastic material, nylon, silicone, cotton, plastic, and the like.

Figure 8:
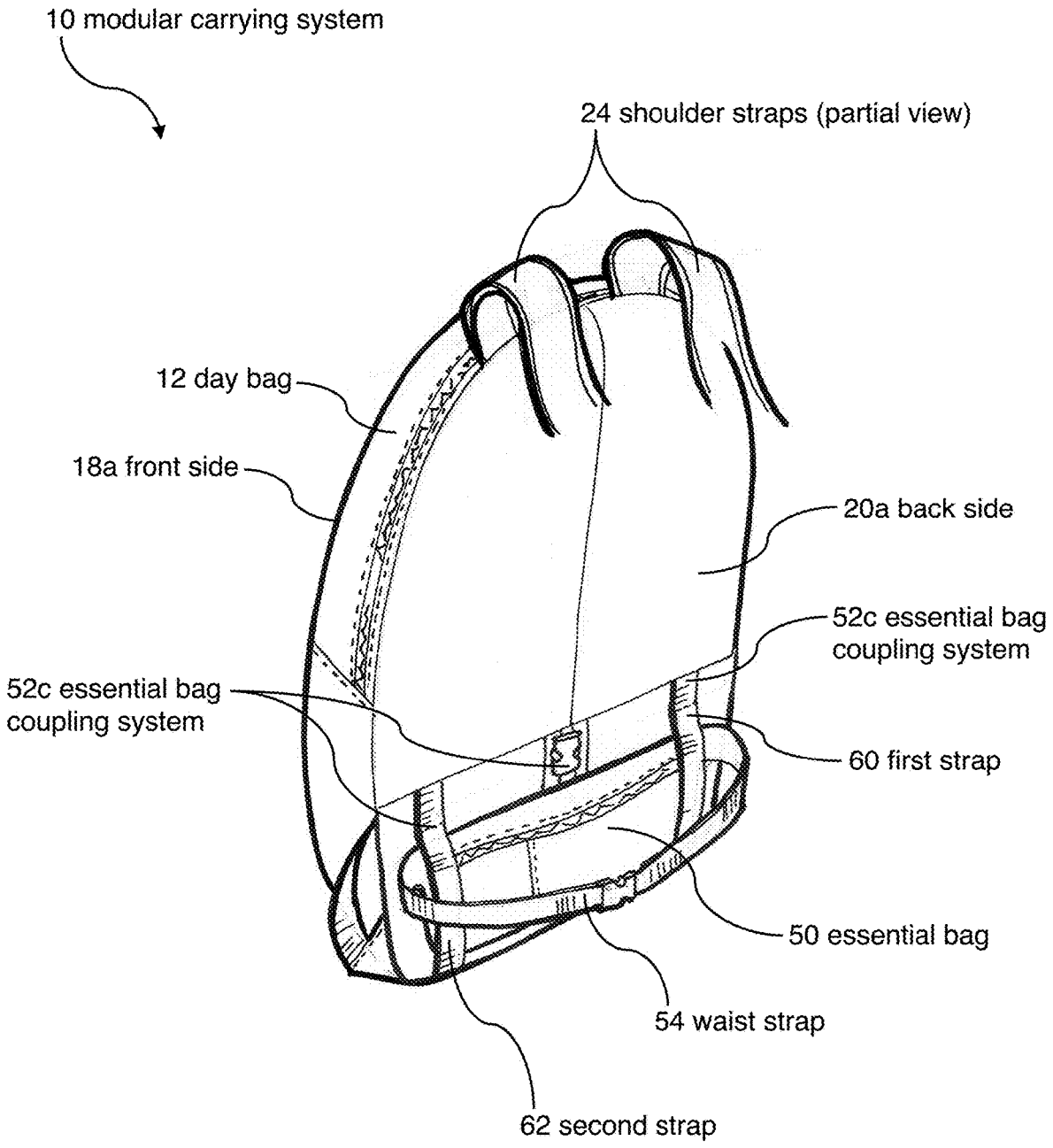

Referring now to FIG. 8, the modular carrying system 10 may include the essential bag 50. The essential bag 50 may include the waist strap 54 and may be arranged and configured to be detachably coupled to the day bag 12. The modular carrying system 10 may further include an essential bag coupling system 52*c*. The essential bag coupling system 52*c* may be located on the back side 20*a* of the day bag 12, along a bottom portion of the back side 20*a*.

In some embodiments, the essential bag coupling system 52*c* includes a first strap 60 and a second strap 62. The first strap 60 and the second strap 62 may be coupled to the back side 20*a* of the day bag 12. The second strap 62 may be spaced from the first strap 60. The waist strap 54 of the essential bag 50 may be arranged and configured to wrap around the first strap 60 and the second strap 62 to thereby detachably couple the essential bag 50 to the day bag 12.

In some embodiments, the essential bag coupling system 52*c* further includes a buckle. The back side 20*a* of the day bag 12 may include at least one of a male portion of the buckle and a female portion of a buckle, and the essential bag 50 may include at least one of a male portion of a buckle and a female portion of the buckle. The portion of the buckle on the day bag 12 may couple to the portion of the buckle on the essential bag 50 to thereby securely couple the essential bag 50 to the day bag 12. In some embodiments, the day bag 12 includes the male portion of the buckle, and the essential bag 50 may include the female portion of the buckle.

Figure 9:
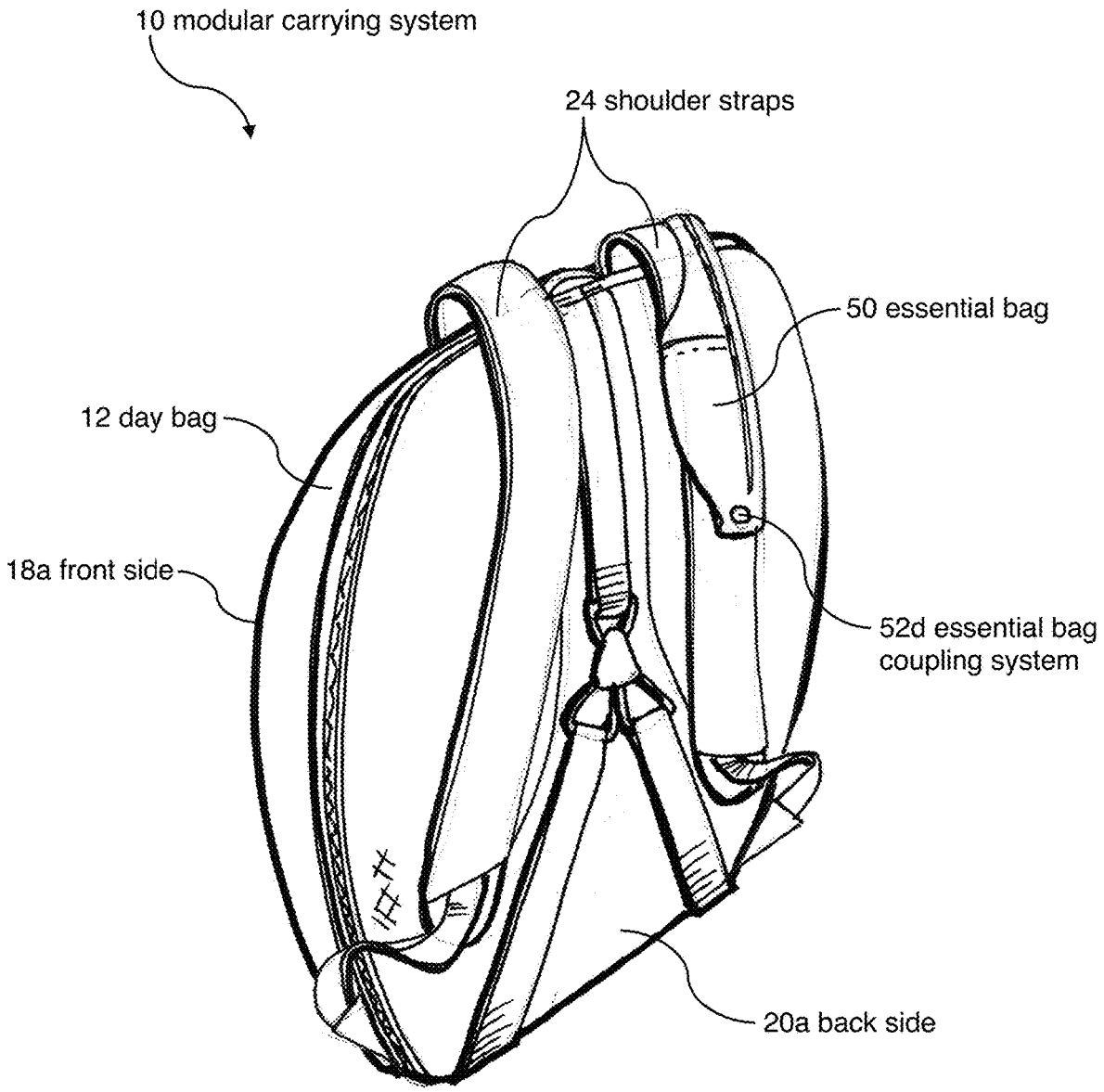

With reference to FIG. 9, the day bag 12 may further include an essential bag coupling system 52*d*. The essential bag coupling system 52*d* may be located on at least one of the shoulder straps 24 of the day bag 12. The essential bag coupling system 52*d* may comprise at least two fasteners. The at least two fasteners may include at least two of a button, snap, clip, clasp, buckle, magnet, and the like.

In some embodiments, the waist strap 54 couples to the essential bag coupling system 52*d*. When the waist strap 54 of the essential bag 50 is wound up and secured by the waist strap management device 56, an outer portion of the waist strap 54 located on the back side of the essential bag 50 may include at least two fasteners. The at least two fasteners may include at least two of a button, snap, clip, clasp, buckle, magnet, and the like. The fasteners of the essential bag coupling system 52*d* may couple to the fasteners of the waist strap 54 of the essential bag 50 such that the essential bag coupling system 52*d* may detachably couple to the essential bag 50.

With added reference to FIG. 9, the essential bag coupling system 52*d* may be located on one or both shoulder straps 24. As such, a plurality of essential bags 50 may be coupled to the shoulder strap 24 of the day bag 12. The position of the essential bag coupling system 52*d* on the shoulder straps 24 of the day bag 12 may allow the user of the modular carrying system 10 quick and easy access to the essential bag 50 and contents thereof.

Figure 10:
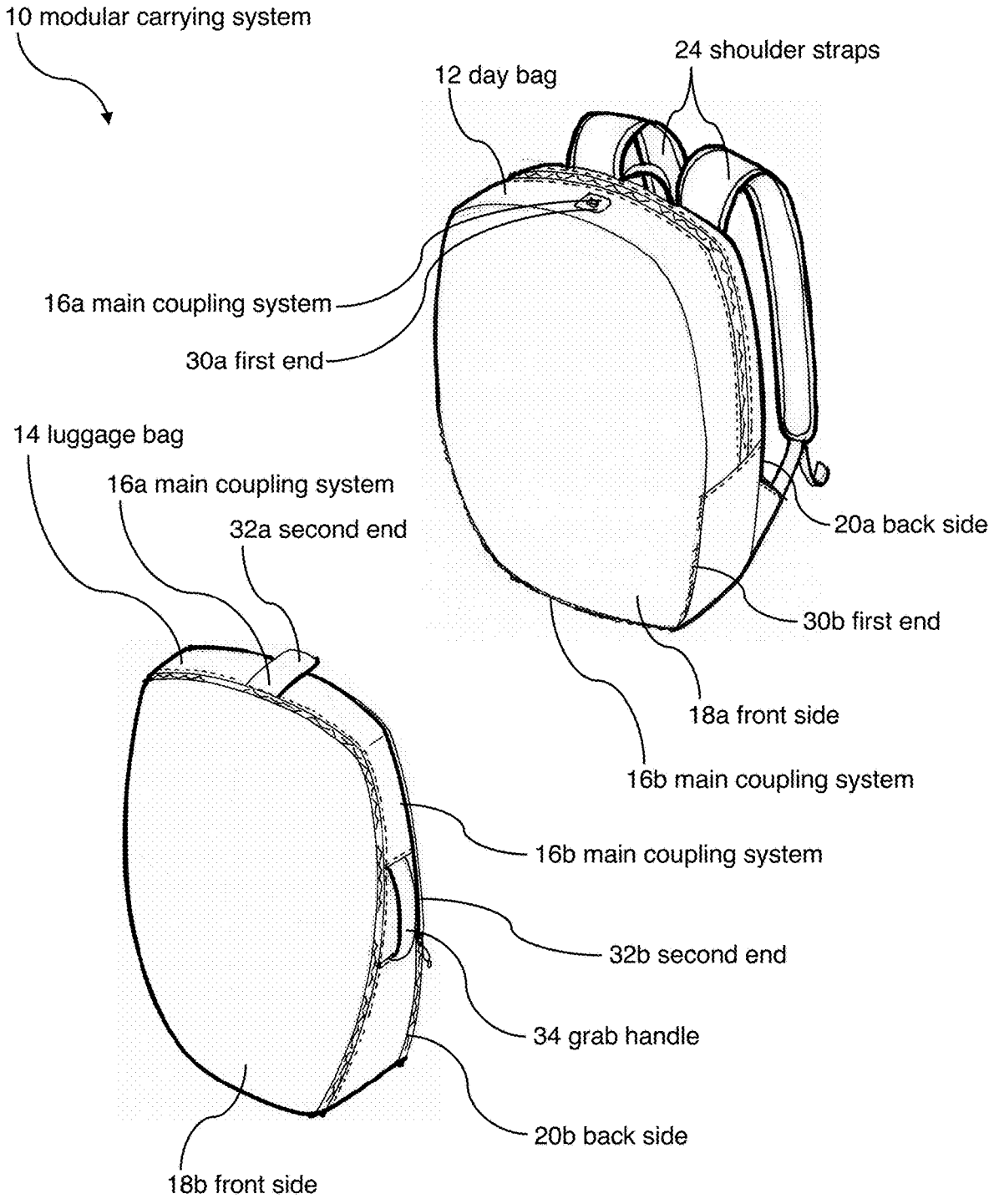
FIG. 10 illustrates an exploded perspective view of a modular carrying system, according to some embodiments.
Figure 11:
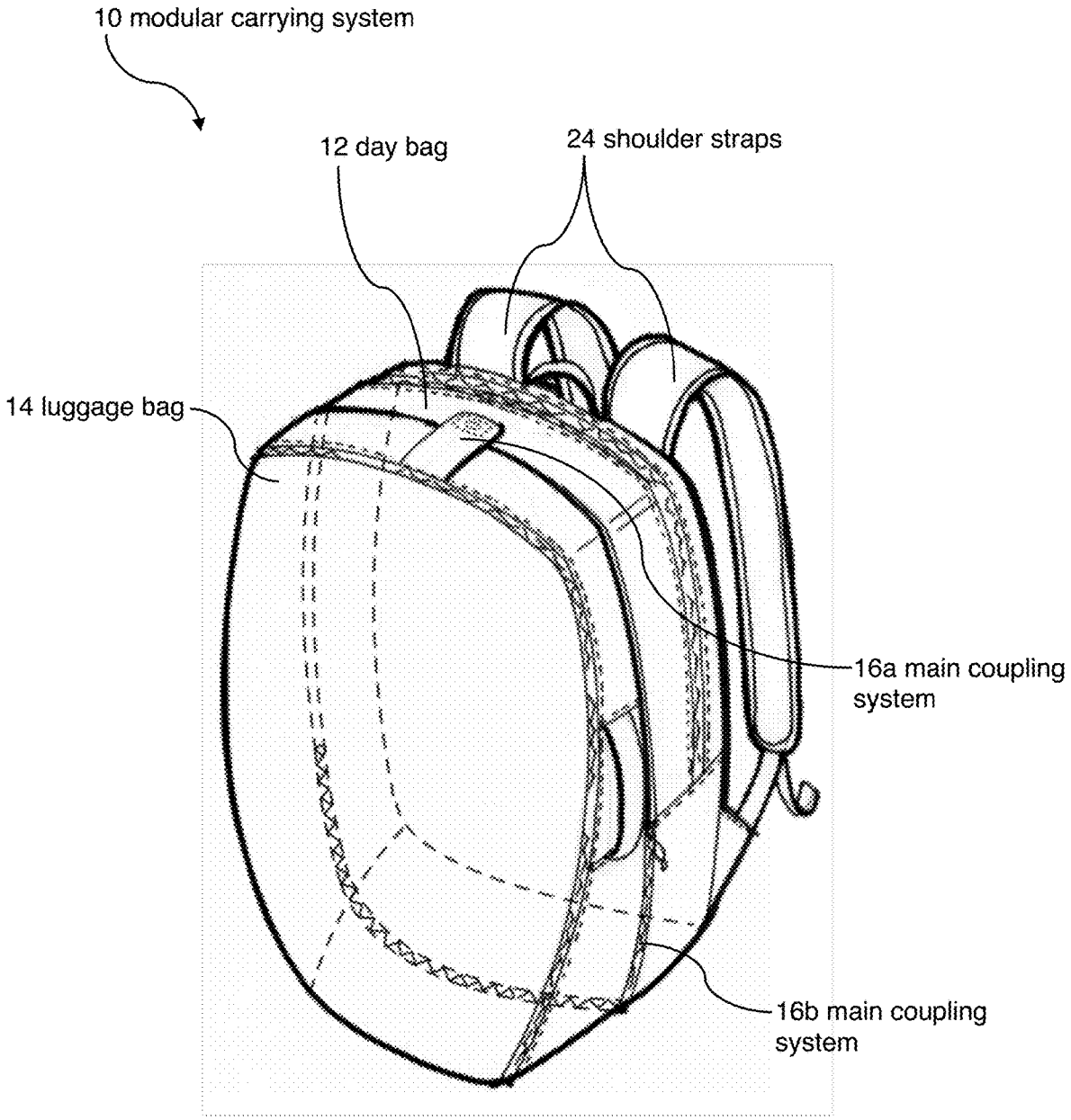
FIG. 11 illustrates a perspective view of a modular carrying system, according to some embodiments.

As illustrated in FIGS. 10 and 11, the modular carrying system 10 may include a plurality of main coupling systems 16. The modular carrying system 10 may comprise the main coupling system 16*a* and a main coupling system 16*b*. The main coupling system 16*a* may comprise at least one of a magnet, buckle, clip, clasp, snap, flap, button, and the like. The main coupling system 16*a* may be located along a top portion of the day bag 12 and a top portion of the luggage bag 14.

As illustrated in FIG. 10, the main coupling system 16*a* may comprise a first end 30*a* and a second end 32*a*. The first end 30*a* may be coupled to the day bag 12 and the second end 32*a* may be coupled to the luggage bag 14. The first end 30*a* and the second end 32*a* may be arranged and configured to lockably couple the day bag 12 and the luggage bag 14 together such that the front side 18*a* of the day bag 12 may face the back side 20*b* of the luggage bag 14.

With added reference to FIGS. 10 and 11, the modular carrying system 10 may include the main coupling system 16*b*. The main coupling system 16*b* may comprise a zipper and may be located around at least a portion of a perimeter of the day bag 12 and the luggage bag 14. The main coupling system 16*b* may be located around at least one of an entire perimeter of the day bag 12 and the luggage bag 14 and a partial perimeter of the day bag 12 and the luggage bag 14.

In some embodiments, the main coupling system includes a first end 30*b* and a second end 32*b*. The first end 30*b* may be located on the day bag 12 and the second end 32*b* may be located on the luggage bag 14. The first end 30*b* and the second end 32*b* may be arranged and configured to lockably couple the day bag 12 and the luggage bag 14 together such that the front side 18*a* of the day bag 12 may face the back side 20*b* of the luggage bag 14.

With continued reference to FIGS. 10 and 11, the modular carrying system 10 may include at least one main coupling system 16. The main coupling system 16 may include at least two of a magnet, a buckle, and a zipper arranged and configured to lockably couple the luggage bag 14 to the day bag 12. The main coupling systems 16*a* and 16*b* may be employed in conjunction to securely couple the day bag 12 and the luggage bag 14, and secure contents thereof.

In some embodiments, the luggage bag 14 includes the grab handle 34. The grab handle 34 may be located along a side portion of the luggage bag 14. The grab handle 34 may be purposed to allow the user of the modular carrying system 10 to utilize the luggage bag 14 separately from the day bag 12. The grab handle 34 may allow the user to comfortably carry the luggage bag 14 in hand.

Figure 12:
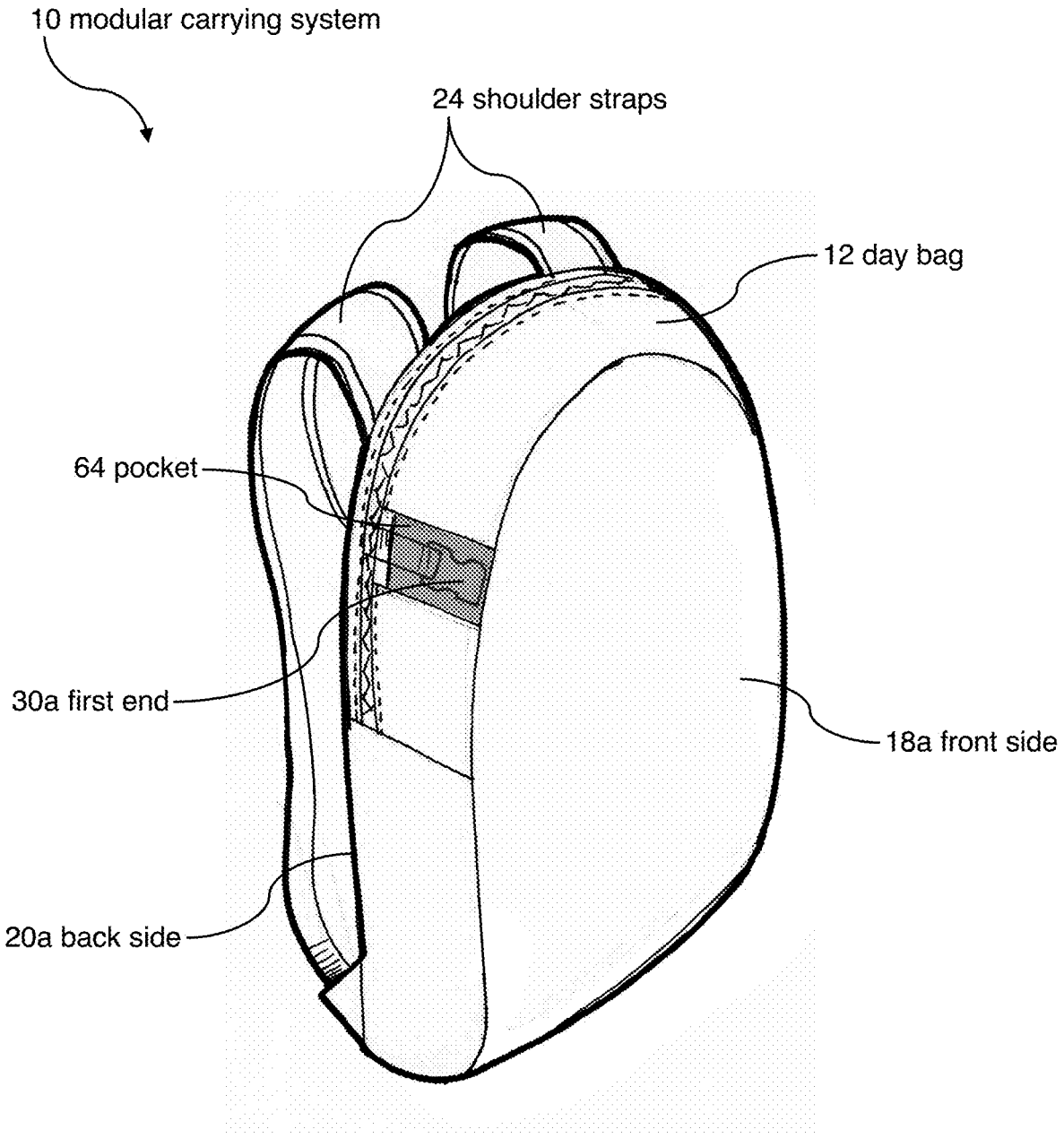
FIGS. 12, 13, and 14 illustrate a perspective view of a day bag of a modular carrying system, according to some embodiments.

As illustrated in FIG. 12, the day bag 12 may include a pocket 64 located along an outer portion of the day bag 12. The pocket 64 may be arranged and configured to receive at least a portion of the main coupling system 16*a*. The pocket 64 may receive the first end 30*a* of the main coupling system 16*a*, as the first end 30*a* may be coupled to the day bag 12. The first end 30*a* may thus be tucked away in the pocket 64 such that the first end 30*a* does not hang from the side of the day bag 12. The pocket 64 may allow the modular carrying system 10 to have a sleek, minimal profile.

In some embodiments, the pocket 64 comprises at least one of Lycra, nylon, silicone, cotton, plastic, and the like. The pocket 64 may define at least one of a square shape, a circular shape, a rectangular shape, an oval shape, and the like. At least one edge of the pocket 64 may not couple to the outer portion of the day bag 12 such that the at least the portion of the main coupling system 16*a* may be received by the pocket 64. It should be appreciated that the pocket 64 may be located along at least one of a top portion and a side portion of the day bag 12 such that the pocket 64 may receive the first end 30*a*.

Figure 13:
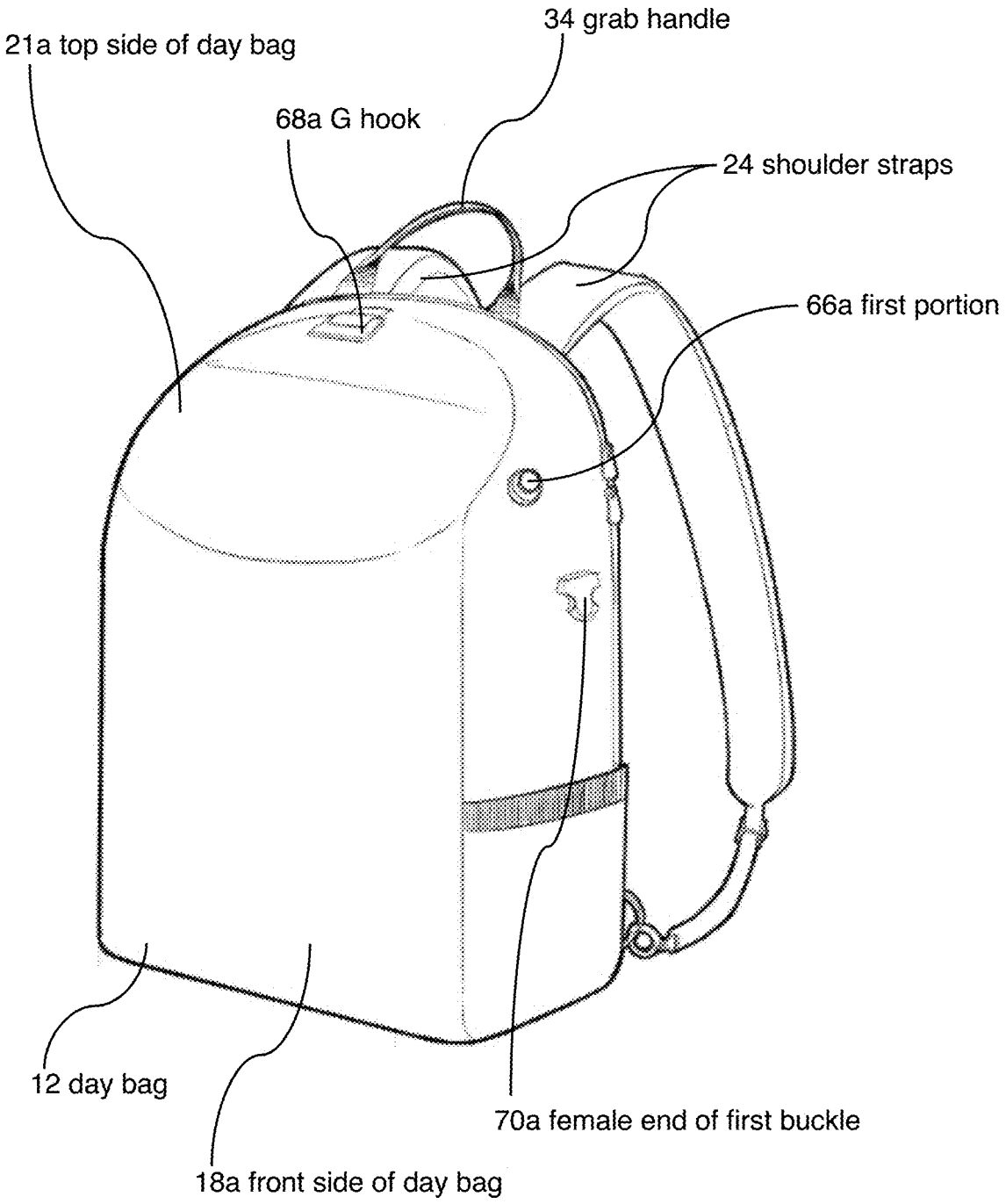

FIG. 13 illustrates another embodiment of the day bag 12. As shown by FIG. 13, in some embodiments the day bag 12 includes a G hook 68*a*. As will be discussed further with reference to FIGS. 15A and 15B, the G hook 68*a* may be used to detachably couple the essential bag 50 to the top side 21*a* of the day bag 12. FIG. 13 also shows a female end of a first buckle 70*a*, which may also be used to detachably couple the essential bag 50 to the top side 21*a* of the day bag 12. At least one buckle and the G hook 68*a* may be used separately or together to couple the essential bag 50 and the top side 21*a* of the day bag 12. The at least one buckle and the G hook 68*a* may be located on different portions of the day bag 12 to thereby couple the essential bag 50 to a different portion of the day bag 12.

FIG. 13 also includes a first portion 66*a* of the main coupling system 16. In many embodiments, the first portion 66*a* is configured to couple with a second portion 66*b* (shown in FIG. 20) of the main coupling system 16. The second portion 66*b* may be located on the luggage bag 14 to thereby detachably couple the day bag 12 and the luggage bag 14. In some embodiments, the main coupling system 16 comprises a magnetic fastener, such as a Fidlock® brand fastener. Any suitable snap, clasp, button, magnetic fastener, or other type of fastener may be used to detachably couple the day bag 12 and the luggage bag 14.

Figure 14:
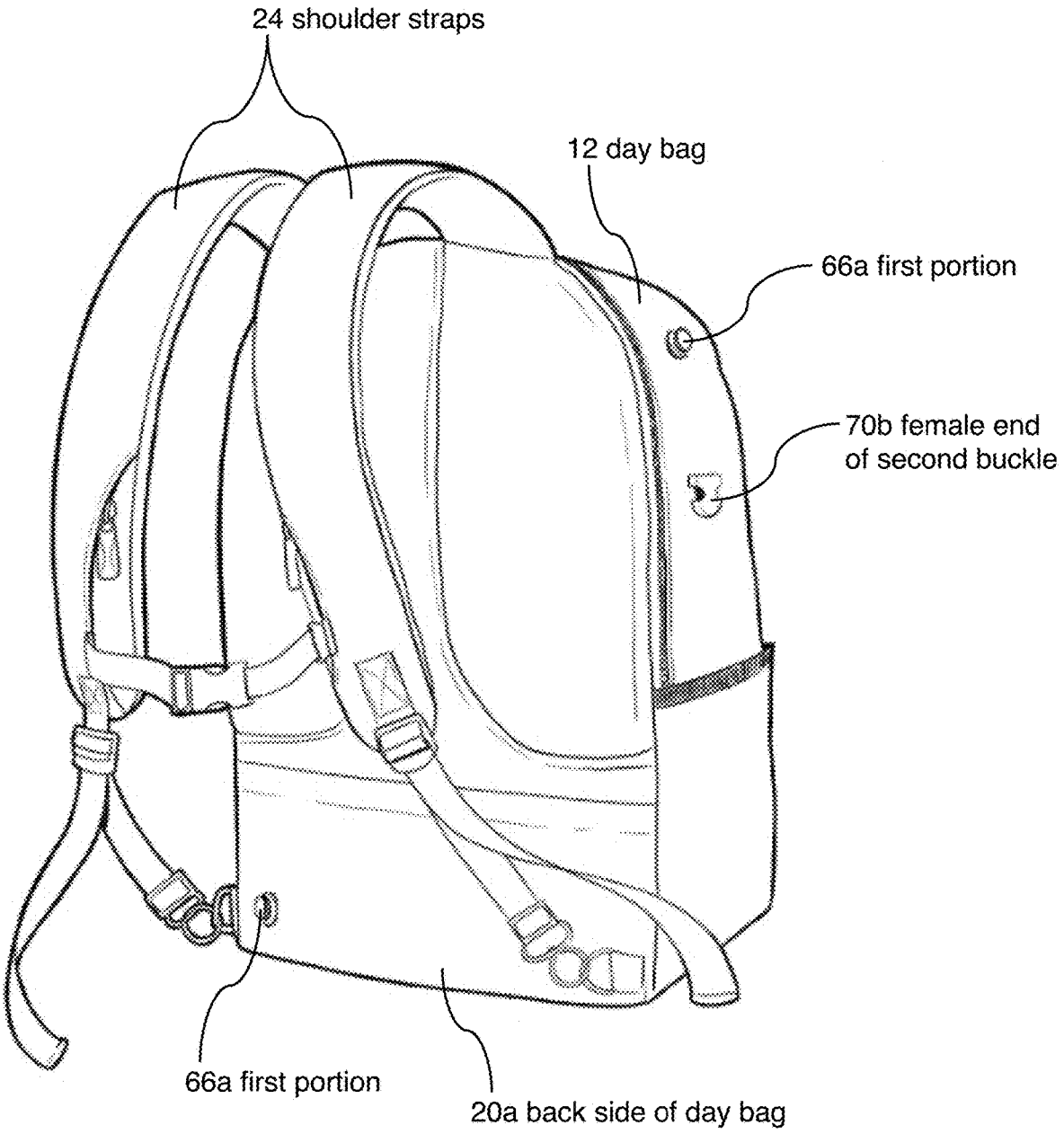

As shown on FIGS. 13 and 14, a first portion 66*a* of the main coupling system 16 may be located on both the top side 21*a* and the back side 20*a* of the day bag 12. FIG. 14 also shows the female end of a second buckle 70*b* located on the opposite side of the day bag 12 from the female end of the first buckle 70*a* (shown in FIG. 13). It should be noted that "female end" and "female portion" may be used interchangeably throughout this disclosure with reference to buckles. Also included in FIG. 14 are the shoulder straps 24. As shown, the shoulder straps 24 may be detachably coupled to the back side 20*a* of the day bag 12, such as with a carabineer or other type of fastener, as previously discussed with reference to FIG. 3. In an embodiment where the day bag 12 is coupled to the luggage bag 14, the shoulder straps 24 may couple to the luggage bag 14. In some embodiments, the shoulder straps 24 comprise two traditional-style straps as shown in the Figures. The day bag 12 may comprise a single shoulder strap designed to be worn on one shoulder, or may comprise a single strap extending diagonally across the day bag 12 to be worn in a cross-body style.

Figure 15A:
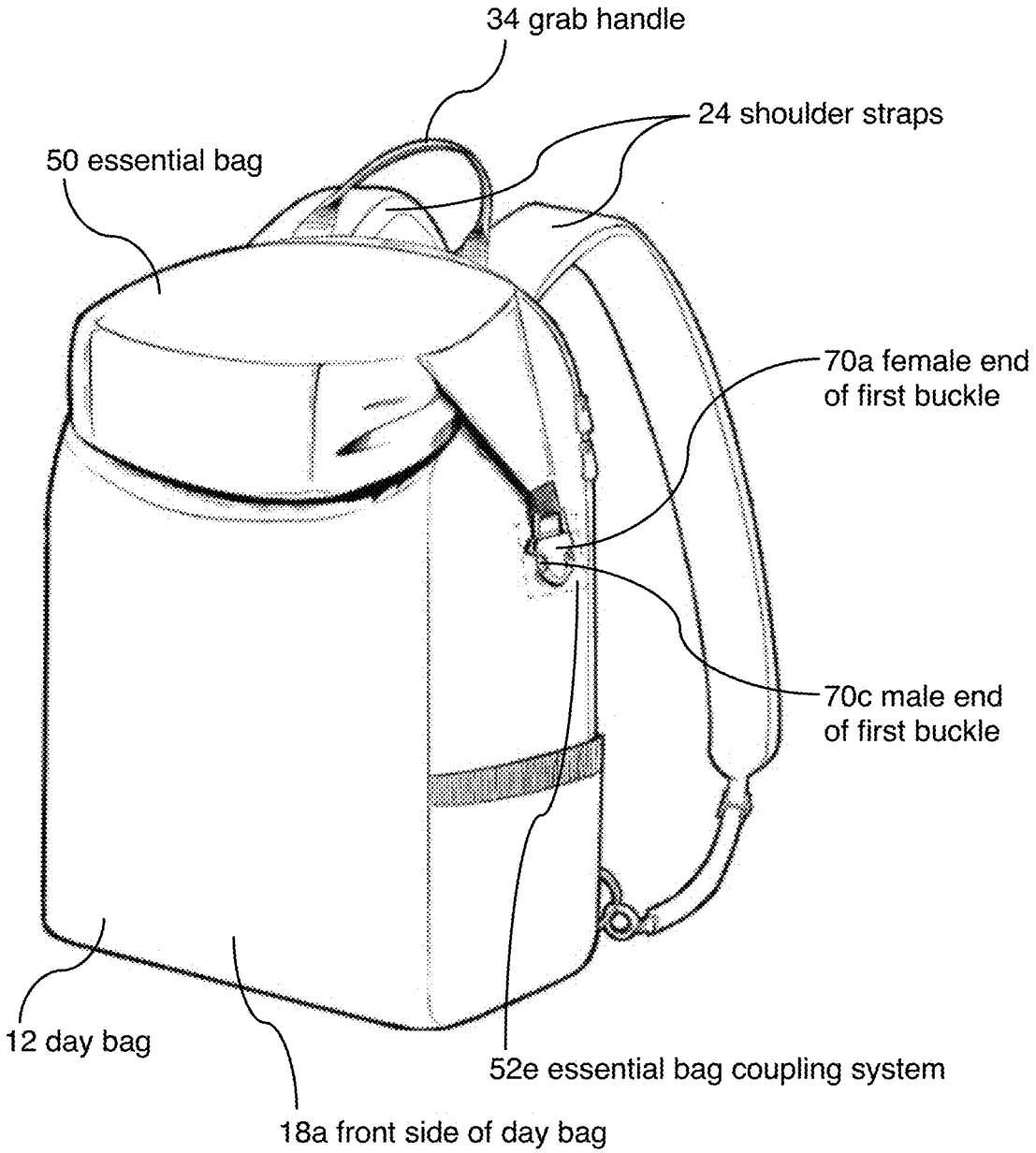
FIGS. 15A and 15B illustrate perspective views of an essential bag coupled to a day bag of a modular carrying system, according to some embodiments.

FIG. 15A shows the day bag 12 coupled to the essential bag 50 via the essential bag coupling system 52*e*. As previously discussed, the day bag 12 may include a female end of a first buckle 70*a*. In some embodiments, the essential bag 50 includes a male end of a first buckle 70*c*, which is configured to couple with the female end 70*a* to thereby couple the essential bag 50 to the day bag 12. It should be noted that "male end" and "male portion" may be used interchangeably throughout this disclosure with reference to buckles. Though not shown, there may also be a second buckle configured to couple the other end of the essential bag 50 to the day bag 12. In an embodiment including the essential bag coupling system 52*e*, the waist strap 54 of the essential bag 50 is detachably coupled to the essential bag 50 such that the waist strap 54 detaches from the essential bag 50 so that the essential bag 50 can couple with the day bag 12. The waist strap 54 may include female buckle ends at each end of the strap 54 configured to couple with the male buckle ends coupled to the essential bag 50. FIG. 15A also includes the grab handle 34.

Figure 15B:
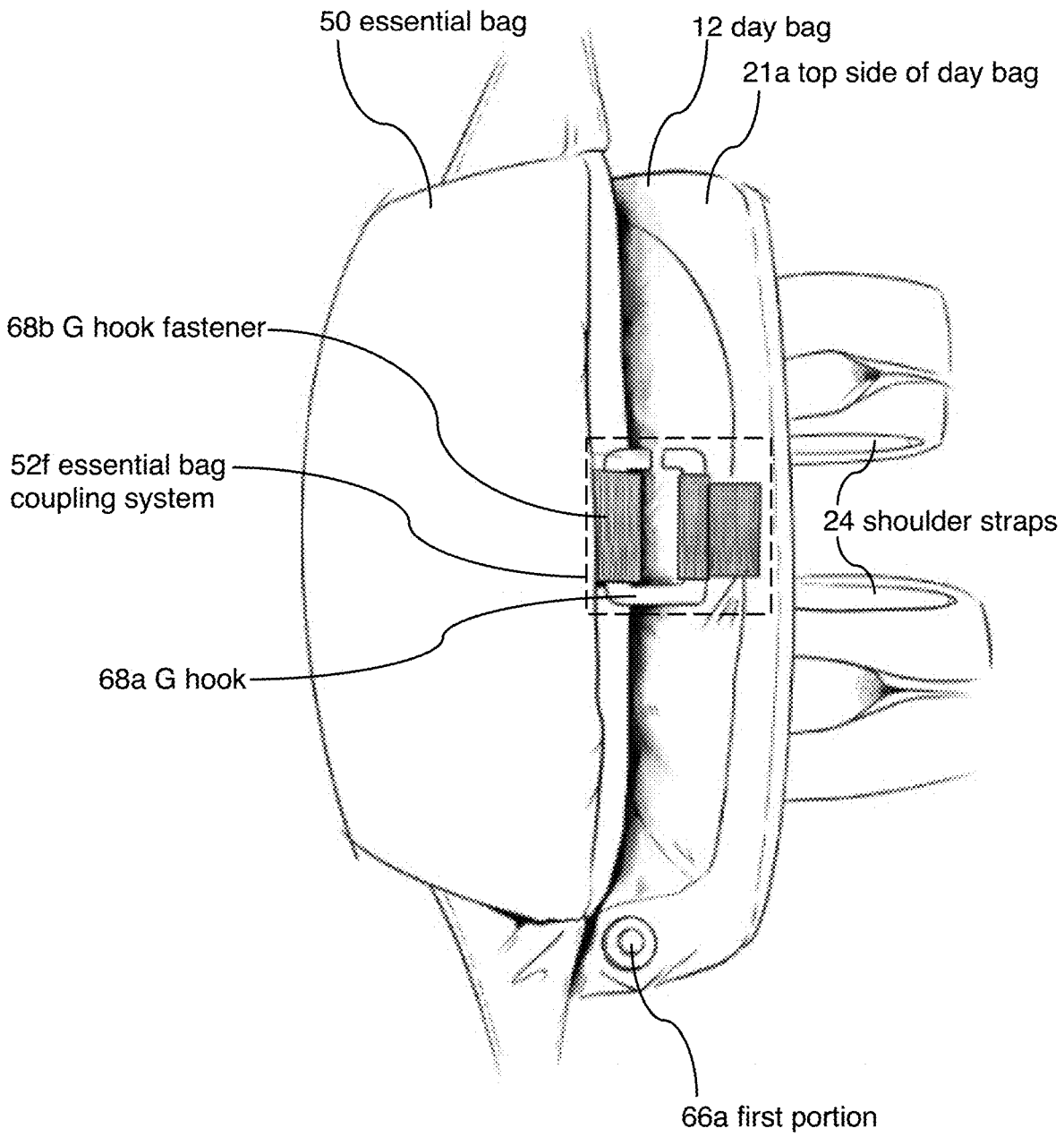

FIG. 15B shows a top view of the essential bag 50 coupled to the top side 21*a* of the day bag 12 via the essential bag coupling system 52*f*. In some embodiments, the essential bag coupling system 52*f* includes the G hook 68*a*, as shown in FIG. 13, and a G hook fastener 68*b*. The G hook 68*a* may be coupled to a top side 21*a* of the day bag 12, and the G hook fastener 68*b* may be coupled to the essential bag 50. In some embodiments, the G hook fastener 68*b* is a loop of mesh, nylon, or any other suitable material attached to the essential bag 50. As previously mentioned, the essential bag coupling system 52*f* may be used independently of or in combination with the essential bag coupling system 52*e* to detachably couple the essential bag 50 to the day bag 12. It should be noted that any suitable type of hook (e.g. S hook or the like) may be used in place of a G hook to detachably couple the essential bag 50 to the day bag 12.

Figure 16:
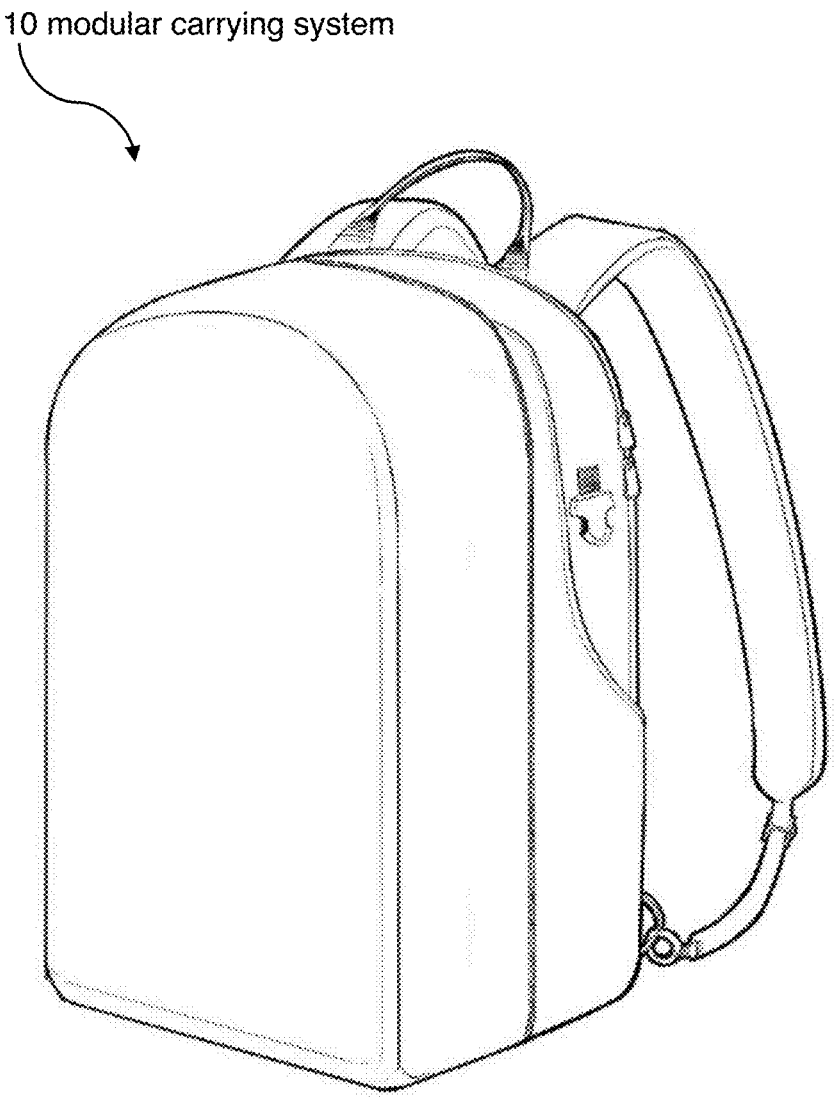
FIGS. 16, 17, and 18 illustrate perspective views of a modular carrying system, according to some embodiments.

FIG. 16 illustrates another embodiment, including the luggage bag 14 and the day bag 12. FIG. 16 also shows the female end of the first buckle 70*a* coupled to the day bag 12. In some embodiments, the essential bag 50 is coupled to the day bag 12 via the essential bag coupling system 52*e*, shown in FIG. 15A, while the day bag 12 is also coupled to the luggage bag 14. The shoulder straps 24 are shown coupled to the luggage bag 14 in FIG. 16. As previously discussed in this disclosure, the shoulder straps 24 may couple to the luggage bag 14 via fasteners located on a lower back portion of the large pouch 40. The shoulder straps 24 may also couple to the luggage bag 14 via fasteners located on the lower back portion of the day bag 12, wherein the luggage bag 14 may comprise holes in the large pouch 40 to enable the fasteners coupled to the day bag 12 to pass through the large pouch 40 before coupling to the shoulder straps 24.

In some embodiments, the luggage bag 14 includes a large pouch 40 located on a back side 20*b* (not labeled) of the luggage bag 14. In many embodiments, the large pouch 40 is sized and configured to receive at least a portion of the day bag 12 such that the front side 18*a* of the day bag 12 faces the back side 20*b* of the luggage bag 14, as seen in FIG. 16. Though not shown in FIG. 16, when the essential bag 50 is coupled to the day bag 12, the large pouch 40 may receive at least a portion of the essential bag 50.

Figure 17:
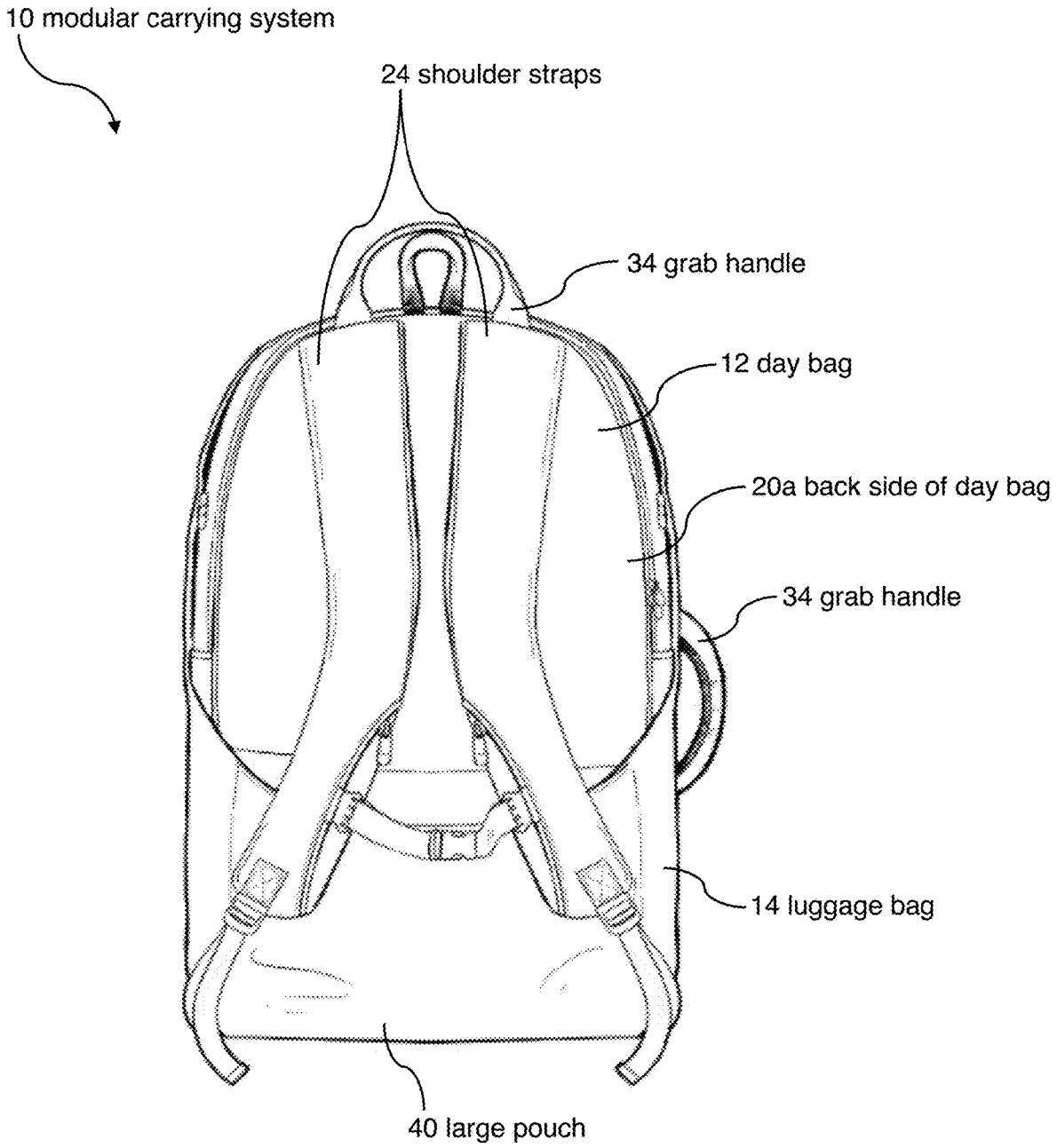

FIG. 17 shows a back view of the modular carrying system 10 and illustrates another view of how the large pouch 40 receives at least a portion of the day bag 12. In some embodiments, the large pouch 40 is sized to receive much of the lower portion of the day bag 12. The large pouch 40 may be sized to receive more or less of the day bag 12. In some embodiments, the large pouch 40 is sized to receive about half of the day bag 12. FIG. 17 also shows that, in some embodiments, the luggage bag 14 includes a grab handle 34 on the side of the luggage bag 14.

Figure 18:
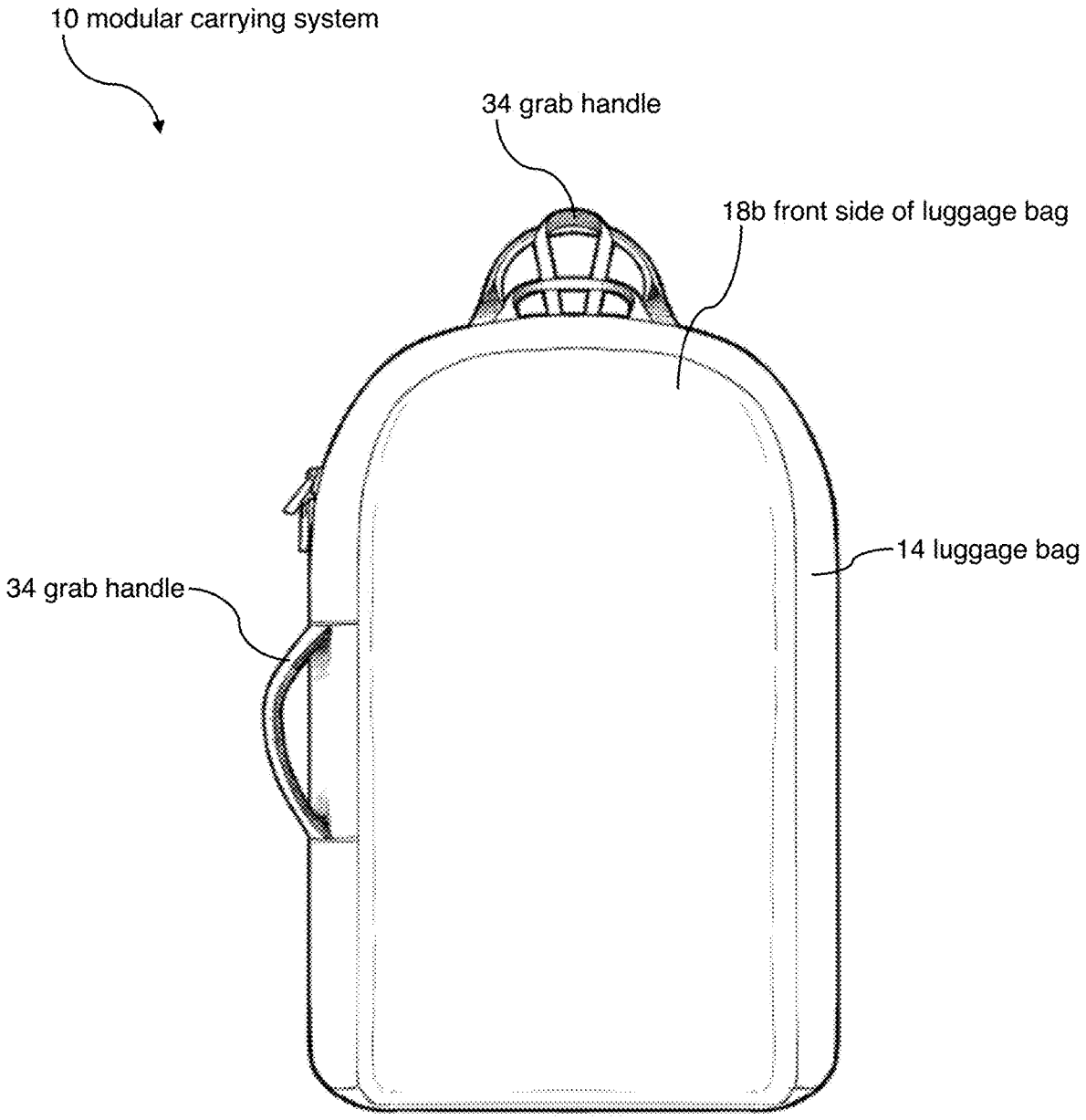

FIG. 18 shows a front view of the modular carrying system 10, including the luggage bag 14. Though not shown with any exterior pockets, in some embodiments, the luggage bag 14 includes at least one exterior pocket. Also, the day bag 12 may include at least one exterior pocket in addition to the side pockets shown in the previous Figures.

Figure 19:
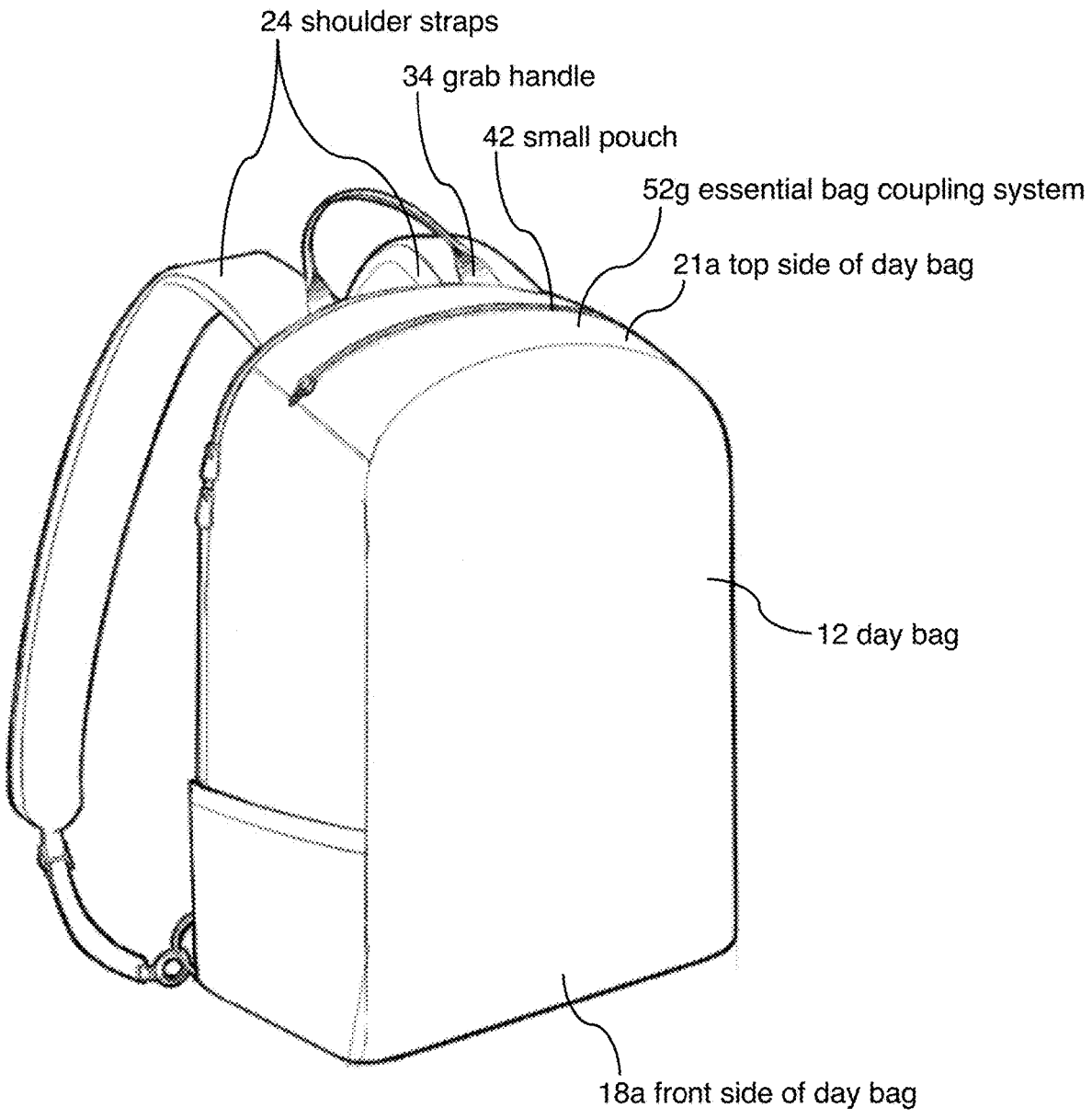
FIG. 19 illustrates a perspective view of a day bag of a modular carrying system, according to some embodiments.

FIG. 19 illustrates an embodiment of the day bag 12 that includes a small pouch 42 on the top side 21*a* of the day bag 12. In some embodiments, the small pouch 42 is configured to at least partially retain the essential bag 50 within the small pouch 42. In this capacity, the small pouch 42 may function as the essential bag coupling system 52*g*. In some embodiments, and as shown in FIGS. 7B and 7C, the small pouch 42 is located elsewhere on the day bag 12. Though the small pouch 42 is shown with a zipper closure, the small pouch 42 may include any other suitable type of closure (e.g. snaps, hook and loop fastener, elastic, drawstring, and the like). In some embodiments, the small pouch 42 does not have a closure.

Figure 20:
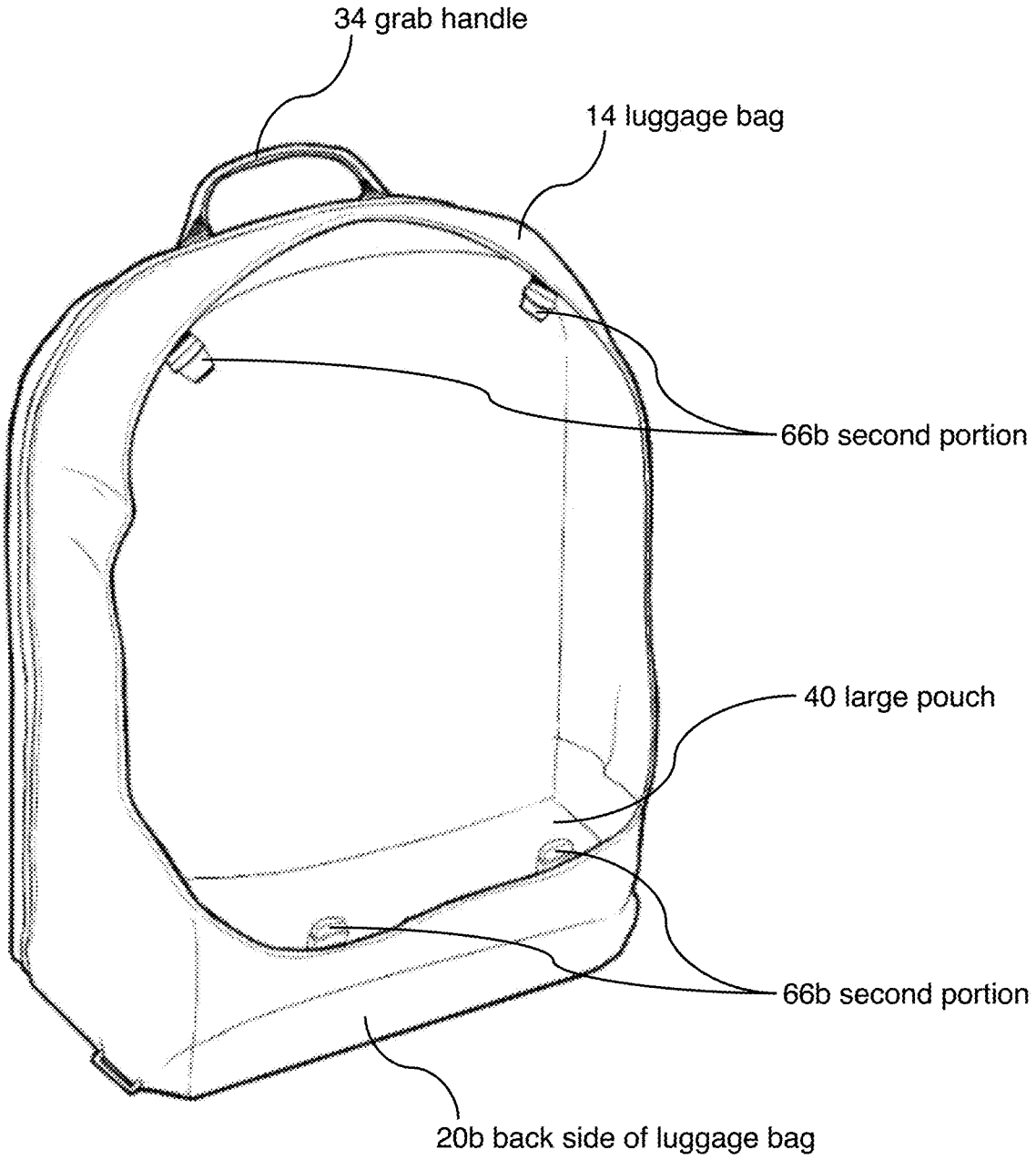
FIG. 20 illustrates a perspective view of a luggage bag of a modular carrying system, according to some embodiments.

Finally, FIG. 20 shows the large pouch 40 in greater detail. As illustrated, the large pouch 40 may include at least one second portion 66*b* of the main coupling system 16. In some embodiments, the second portion 66*b* is configured to couple with the first portion 66*a* illustrated in FIGS. 13 and 14 to thereby couple the day bag 12 to the luggage bag 14. As previously mentioned, the main coupling system 16 may comprise at least one magnetic fastener or other suitable fastening mechanism. In many embodiments, the first portions 66*a* located on the top side 21*a* of the day bag 12 are configured to couple with the second portions 66*b* located on the upper portion of the large pouch 40, and the first portions 66*a* located on the back side 20*a* of the day bag 12 are configured to couple with the second portions 66*b* located on the lower portion of the large pouch 40. Though shown with four second portions 66*b*, the luggage bag 14 may include more or less than four second portions 66*b* of the main coupling system 16.

At least one of the day bag 12, the luggage bag 14, and the essential bag 50 may comprise any suitable material or combination of materials, such as nylon, cotton, plastic, metal, or the like. In many embodiments, the day bag 12 is sized similar to a "typical" backpack, such as those often used for school and/or work. As previously mentioned, the essential bag 50 may be sized similar to a traditional waist pack or "fanny pack". The luggage bag 14 may be sized larger than the day bag 12 but may remain an appropriate size to be comfortably carried on a user's back or by hand.

INTERPRETATION

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

The term "substantially" is used to mean "completely" and/or "nearly completely". For example, on page 13 the disclosure includes, "The padding may disperse the weight of the day bag 12 along substantially an entire surface of the user's back and may thus prevent weight of the day bag 12 from being focused on a single area where the day bag 12 may meet the back of the user." In this context, "substantially" is used to mean that the weight of the day bag may be dispersed along a majority of the user's back, nearly the entire surface of the user's back, or the entire surface of the user's back.

The term "neatly tucked away" is used to indicate that a component of the system is stored in a nonobstructive manner. For example, page 3 of this disclosure includes, "The waist strap management device may be arranged and configured to receive at least a portion of the waist strap and thereby keep the at least the portion of the waist strap neatly tucked away." In this context, "neatly tucked away" indicates that the at least the portion of the waist strap is stored by the waist strap management device in such a manner that the portion is not loose or obstructive (e.g., dangling, loose, susceptible to getting caught on something in the environment, etc.) to a user of the modular carrying system.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

What is claimed is:

1. A modular carrying system, comprising:

a day bag having a front side, a back side located opposite the front side, a hollow inner portion located between the front side and the back side, a pair of shoulder straps extending away from the back side, and a first fastener arranged and configured to open and close the hollow inner portion;

a luggage bag having a front side, a back side located opposite the front side, a hollow inner portion located between the front side and the back side, and a second fastener arranged and configured to open and close the hollow inner portion;

a main coupling system having a first portion coupled to the day bag and a second portion coupled to the luggage bag, the main coupling system arranged and configured to detachably couple the day bag and the luggage bag together such that the front side of the day bag faces the back side of the luggage bag; and a large pouch located on the back side of the luggage bag, the large pouch arranged and configured to receive at least a portion of the day bag.

2. The modular carrying system of claim 1, wherein a lower portion of the large pouch defines a substantially rectangular shape and an upper portion of the large pouch defines a substantially ovoid shape, and wherein the lower portion defines a greater depth than the upper portion.

3. The modular carrying system of claim 1, wherein the day bag comprises a small pouch located along at least one of a top side of the day bag and the back side of the day bag, the system further comprising an essential bag sized and configured to be detachably retained within the small pouch.

4. The modular carrying system of claim 3, wherein the small pouch comprises a zipper closure.

5. The modular carrying system of claim 3, further comprising an essential bag coupling system coupled to the day bag.

6. The modular carrying system of claim 5, wherein the essential bag coupling system comprises at least one of a G hook and a fastener arranged and configured to securely couple the essential bag to the day bag.

7. The modular carrying system of claim 5, wherein the essential bag coupling system comprises at least one of a magnetic fastener and a buckle arranged and configured to securely couple the essential bag to the day bag.

8. The modular carrying system of claim 5, wherein the essential bag coupling system is located along a top portion of the day bag.

9. The modular carrying system of claim 8, wherein the essential bag coupling system comprises a female end of a first buckle coupled to the top side of the day bag, a female end of a second buckle coupled to the top side of the day bag and spaced from the first buckle, a male end of the first buckle coupled to the essential bag, and a male end of the second buckle coupled to the essential bag, and wherein the female end of the first buckle coupled to the top side of the day bag is arranged and configured to receive the male end of the first buckle coupled to the essential bag and the female end of the second buckle coupled to the top side of the day bag is arranged and configured to receive the male end of the second buckle coupled to the essential bag to thereby detachably couple the essential bag to the day bag.

10. The modular carrying system of claim 3, wherein the essential bag comprises a waist strap and a waist strap management device arranged and configured to receive at least a portion of the waist strap and thereby keep the at least the portion of the waist strap neatly tucked away.

11. The modular carrying system of claim 1, wherein the main coupling system comprises at least one of at least one magnetic fastener, at least one buckle, and at least one zipper arranged and configured to lockably couple the luggage bag to the day bag.

12. The modular carrying system of claim 8, wherein the main coupling system is located along a top portion of the day bag and a top portion of the luggage bag.

13. The modular carrying system of claim 12, wherein the main coupling system is further located along a back portion of the day bag and a back portion of the luggage bag.

14. The modular carrying system of claim 1, wherein the main coupling system comprises at least two of at least one magnetic fastener, at least one buckle, and at least one zipper arranged and configured to lockably couple the luggage bag to the day bag.

15. The modular carrying system of claim 14, wherein the main coupling system comprises the at least one zipper located around at least a portion of a perimeter of the day bag.

16. The modular carrying system of claim 1, wherein the luggage bag comprises a grab handle.

17. The modular carrying system of claim 16, wherein the grab handle is located along a top portion of the luggage bag.

18. The modular carrying system of claim 16, wherein the grab handle is located along a side portion of the luggage bag.

19. The modular carrying system of claim 1, wherein the first portion of the main coupling system is located on at least one of a top side of the day bag and the back side of the day bag, and the second portion of the main coupling system is located on at least one of the upper portion of the large pouch and the lower portion of the large pouch.

20. The modular carrying system of claim 19, wherein the first portion of the main coupling system located on the top side of the day bag is configured to detachably couple with the second portion of the main coupling system located on the upper portion of the large pouch, and the first portion of the main coupling system located on the back side of the day bag is configured to detachably couple with the second portion of the main coupling system located on the lower portion of the large pouch.

* * * * *